US010729969B2

(12) United States Patent
Paul

(10) Patent No.: US 10,729,969 B2
(45) **Date of Patent: *Aug. 4, 2020**

(54) CUSTOMIZABLE PLAYING CARDS WITH INTERCHANGEABLE COMPONENTS

(71) Applicant: Gregory Donald Paul, Downey, CA (US)

(72) Inventor: Gregory Donald Paul, Downey, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,016

(22) Filed: Mar. 22, 2019

(65) Prior Publication Data

US 2020/0047059 A1 Feb. 13, 2020

Related U.S. Application Data

(63) Continuation-in-part of application No. 16/058,870, filed on Aug. 8, 2018, now Pat. No. 10,478,710.

(51) Int. Cl.

| | |
|---|---|
| ***A63F 1/02*** | (2006.01) |
| ***A63F 1/10*** | (2006.01) |
| *A63F 3/00* | (2006.01) |

(52) U.S. Cl.

CPC ..... *A63F 1/02* (2013.01); *A63F 1/10* (2013.01); *A63F 2001/022* (2013.01); *A63F 2003/00716* (2013.01); *A63F 2003/00719* (2013.01); *A63F 2003/00738* (2013.01); *A63F 2003/00826* (2013.01); *A63F 2250/08* (2013.01); *A63F 2250/50* (2013.01); *A63F 2250/60* (2013.01); *A63F 2250/602* (2013.01)

(58) Field of Classification Search

CPC ..... A63F 2250/08; A63F 2250/50; A63F 2250/60; A63F 1/02; A63F 1/10; A63F 2003/00716; A63F 2003/00719; A63F 2003/00826; A63F 2003/00738; A63F 2250/602

USPC .... 273/293, 276, 290, 288, 148 A, 456, 296

See application file for complete search history.

(56) References Cited

U.S. PATENT DOCUMENTS

| | | | | |
|---|---|---|---|---|
| 2,521,017 A | | 9/1950 | Moen et al. | |
| 4,170,358 A | | 10/1979 | Hancock | |
| 5,071,136 A | * | 12/1991 | Lott | A63F 3/00041 273/259 |

(Continued)

FOREIGN PATENT DOCUMENTS

| | | |
|---|---|---|
| FR | 2794058 | 7/2001 |
| JP | 2008528119 | 7/2008 |
| RU | 104515 | 5/2011 |

*Primary Examiner* — Benjamin Layno

(74) *Attorney, Agent, or Firm* — Cionca IP Law P.C.; Marin Cionca

(57) ABSTRACT

A customizable playing card having: a plurality of connectable surfaces, wherein each surface is capable of being removably adhered to each other surface via static electricity; a first card component having: a front first card component face; and a back first card component face; and a second card component that joins with the first card component via the static electricity; the second card component having: a front second card component face; and a back second card component face; wherein the first card component connects to the second card component such that the front first component face is the front card face; and such that the front second component face is opposite to the front first component face and is the back card face.

20 Claims, 13 Drawing Sheets

(56) References Cited

U.S. PATENT DOCUMENTS

| | | | | |
|---|---|---|---|---|
| 5,458,282 | A | 10/1995 | Martin | |
| 5,632,489 | A | 5/1997 | Rozzi, Sr. et al. | |
| 5,887,899 | A | 3/1999 | Dobbins | |
| 6,435,508 | B1 | 8/2002 | Tavel | |
| 6,604,741 | B1 | 8/2003 | Snow | |
| 7,900,845 | B2 | 3/2011 | Stagg | |
| 10,478,710 | B1 * | 11/2019 | Paul | H01F 7/02 |
| 2008/0217907 | A1 | 9/2008 | Dean et al. | |
| 2011/0056101 | A1 * | 3/2011 | Basso | A63F 1/02<br>40/124.191 |

* cited by examiner 103b
103
63 mm
36 mm
103a 102b
102
63 mm
NAME
52 mm
102a 101b
101
NAME
101a 105
106
104b
104
63 mm
GAME
LOGO
88 mm
104a 111
101
NAME 102
103
101f
111

104
0.5 mm

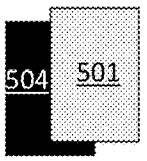
Fig. 5a
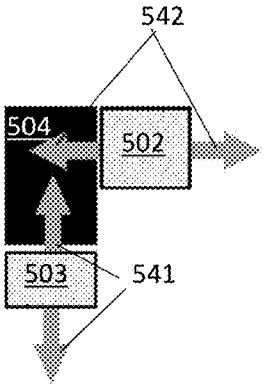
Fig. 5b
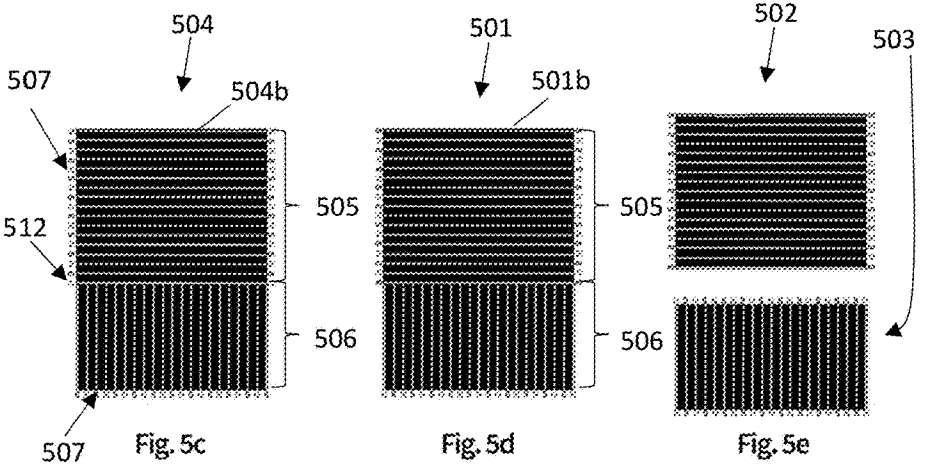
Fig. 5c
Fig. 5d
Fig. 5e
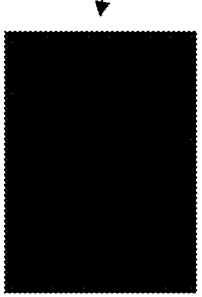
Fig. 5f
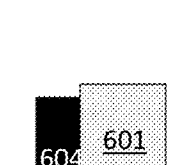
Fig. 6a
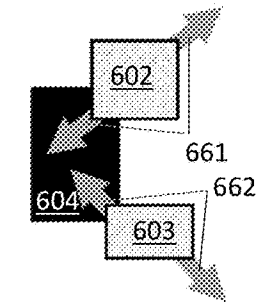
Fig. 6b
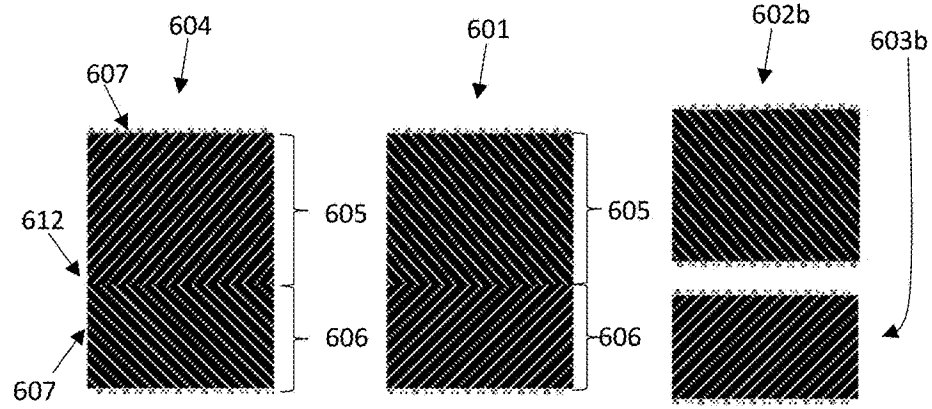
Fig. 6c
Fig. 6d
Fig. 6e
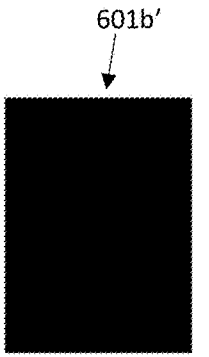
Fig. 6f

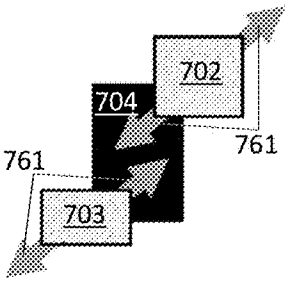
Fig. 7b
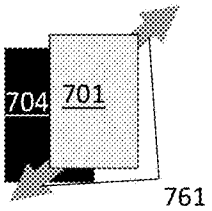
Fig. 7a
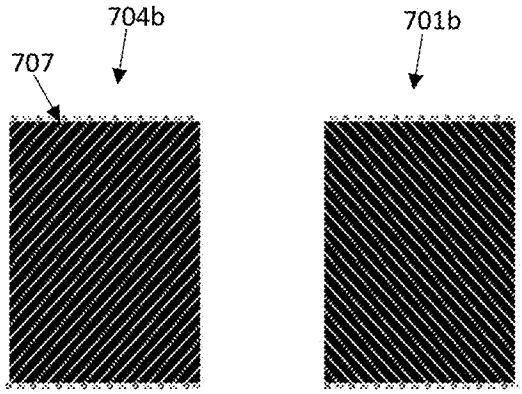
Fig. 7c
Fig. 7d
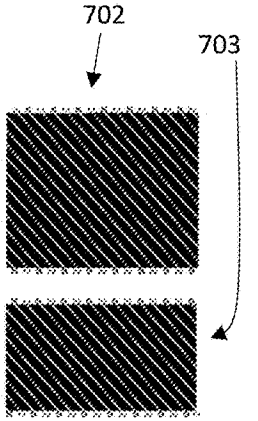
Fig. 7e
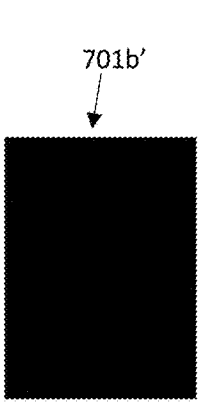
Fig. 7f
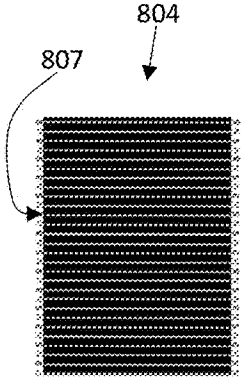
Fig. 8c
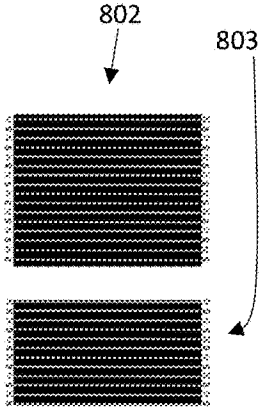
Fig. 8d
Fig. 8e
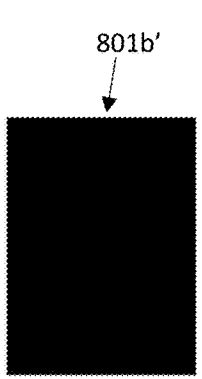
Fig. 8f
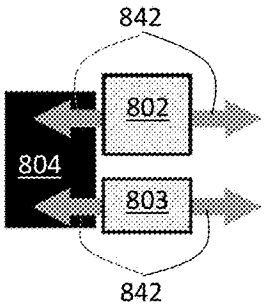
Fig. 8b
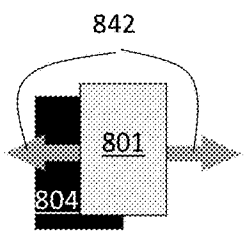
Fig. 8a

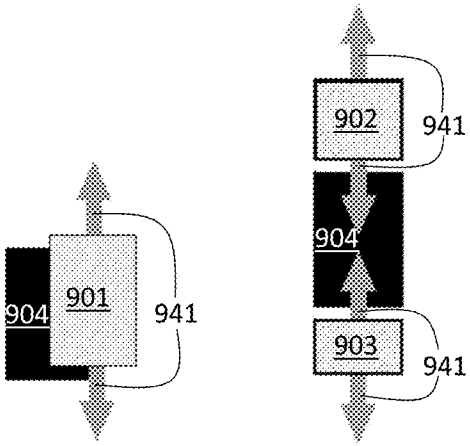
Fig. 9a
Fig. 9b
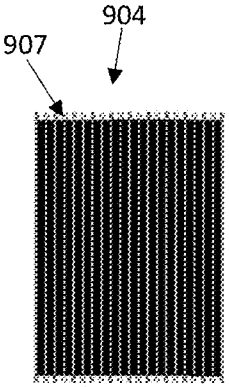
Fig. 9c
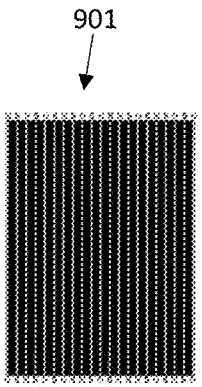
Fig. 9d
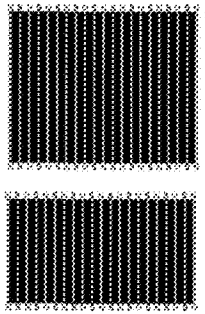
Fig. 9e
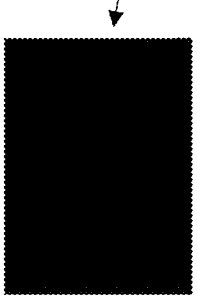
Fig. 9f

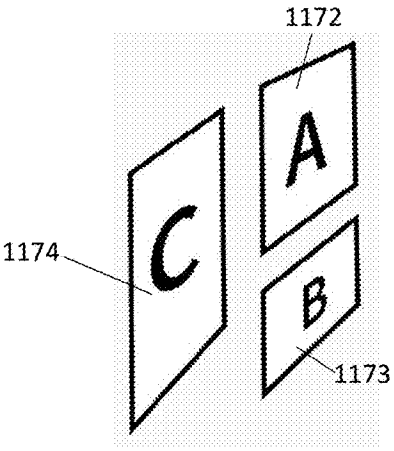
Fig. 11a
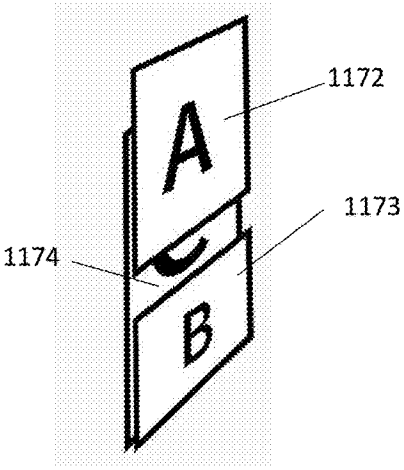
Fig. 11b
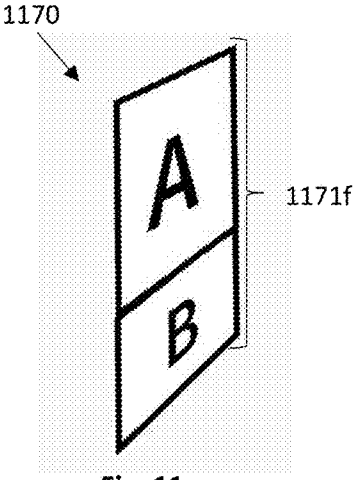
Fig. 11c
Fig. 12a
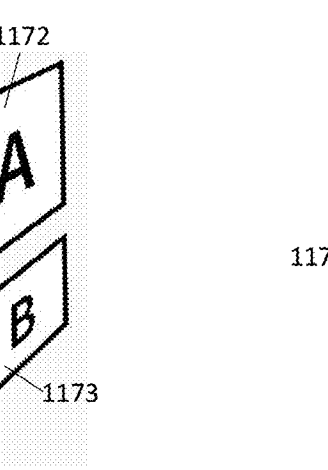
Fig. 12b
Fig. 12c
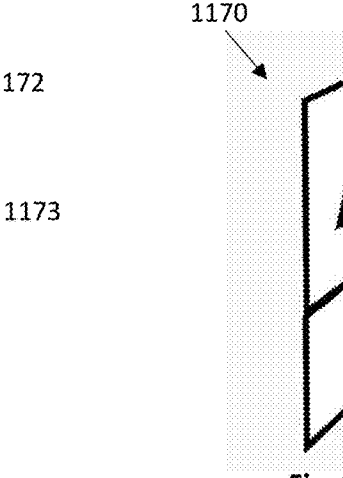
Fig. 12d
Fig. 12e

CUSTOMIZABLE PLAYING CARDS WITH INTERCHANGEABLE COMPONENTS

CROSS-REFERENCE TO RELATED APPLICATIONS

This application is a continuation-in-part of and claims the benefit of U.S. Non-Provisional application Ser. No. 16/058,870, filed Aug. 8, 2018, which is hereby incorporated by reference, to the extent that it is not conflicting with the present application.

BACKGROUND OF INVENTION

1. Field of the Invention

The invention relates generally to playing cards and more particularly to customizable playing cards with interchangeable components.

2. Description of the Related Art

Traditional playing cards, such as standard decks of cards or cards used for collectible games, are limited in that each card has only one variation. In the case of a trading card game, players must buy packs of new cards to upgrade their deck and develop new card combinations. Additionally, if players wish to trade cards, then each player risks losing important abilities or characters. The limitations of traditional playing cards can also halt game creators from designing new and innovative games. Traditional playing cards are also not very durable. They are often made of a cardstock or similar material, which can be easily damaged via water or tearing, or general wear and tear. Some materials used for constructing customizable playing cards may be cost prohibitive, and thus raise the price of the cards. Thus, there is a need for a new and improved playing cards that address and solve the problems outlined above.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a customizable playing card is provided, comprising: a front card face; a back card face; a top card end; a bottom card end; a plurality of connectable surfaces, wherein each surface of the plurality of connectable surfaces is capable of being removably adhered to each other surface of the plurality of connectable surfaces via static electricity; a first card component; and a second card component that joins with the first card component via the static electricity to form the customizable playing card; the first card component having: a front first card component face; a back first card component face; and a first set of dimensions; the second card component having: a front second card component face; a back second card component face; an interlocking means having a first interlocking section, and a second interlocking section; a first portion, wherein the first interlocking section is on the first portion; and a second portion that joins with the first portion to form the second card component, wherein the second interlocking section is on the section portion, and wherein the first portion and the second portion are joined together via the interlocking means; wherein the first portion together with the second portion have the first set of dimensions; a plurality of combinable card sleeves, wherein each card sleeve of the plurality of combinable card sleeves is capable of being removably adhered to each other card sleeve of the plurality of combinable card sleeves, the plurality of combinable card sleeves comprising: a full size card sleeve having a full size card sleeve exterior, and a full size card sleeve interior, the full size card sleeve being adapted to receive the first card component into the full size card sleeve interior; a first partial size card sleeve having a first partial size card sleeve exterior, and a first partial size card sleeve interior, the first partial size card sleeve being adapted to receive the first portion into the first partial size card sleeve interior; and a second partial size card sleeve having a second partial size card sleeve exterior, and a second partial size card sleeve interior, the second partial size card sleeve being adapted to receive the second portion into the second partial size card sleeve interior; wherein the plurality of connectable surfaces comprises the front first card component face, the back first card component face, the front second card component face; the back second card component face; the full size card sleeve exterior, the first partial size card sleeve exterior, and the second partial size card sleeve exterior; wherein the first partial size card sleeve exterior and the second partial size card sleeve exterior each connect with the full size card sleeve exterior; such that the front first component face is visible and comprises the front card face; and such that the front second component face is opposite to the front first component face and is visible and comprises the back card face. Thus, an advantage is that a set of cards may be easily and efficiently changed, upgraded, or otherwise manipulated such that a user can alter their selection of cards without the need for purchasing additional cards or card parts. Another advantage may be that a user may more easily trade cards or card components with another user. Another advantage may be that the materials used to construct the customizable playing cards may be easily obtained and cost-effective. Another advantage may be that the statically charged customizable playing cards may be light and thus easy to shuffle and handle, while still providing a means for removably adhering the card components to one another. Another advantage is that the individual pieces or portions of the customizable playing cards may be easily and efficiently attached to and removed from one another without the need for moving or sliding the pieces in any particular direction or manner.

In another aspect, a customizable playing card is provided, comprising: a front card face; a back card face; a top card end; a bottom card end; a plurality of connectable surfaces, wherein each surface of the plurality of connectable surfaces is capable of being removably adhered to each other surface of the plurality of connectable surfaces via static electricity; a first card component; and a second card component that joins with the first card component via the static electricity to form the customizable playing card; the first card component having: a front first card component face; a back first card component face; and a first set of dimensions; the second card component having: a front second card component face; a back second card component face; an interlocking means having a first interlocking section, and a second interlocking section; a first portion, wherein the first interlocking section is on the first portion; and a second portion that joins with the first portion to form the second card component, wherein the second interlocking section is on the section portion, and wherein the first portion and the second portion are joined together via the interlocking means; wherein the first portion together with the second portion have the first set of dimensions; a card frame having: a front frame piece; a back frame piece; a frame exterior; and a frame interior; wherein the card frame is adapted to receive the first card component and the second card component into the frame interior; wherein the plurality of connectable surfaces comprises the front first card component face, the back first card component face, the front second card component face; the back second card component face; the front frame piece, and the back frame piece; wherein the first card component and the second card component are connected together within the card frame; such that the front first component face is visible and comprises the front card face; and such that the front second component face is opposite to the front first component face and is visible and comprises the back card face. Thus, again, an advantage is that a set of cards may be easily and efficiently changed, upgraded, or otherwise manipulated such that a user can alter their selection of cards without the need for purchasing additional cards or card parts. Another advantage may be that a user may more easily trade cards or card components with another user. Another advantage may be that the materials used to construct the customizable playing cards may be easily obtained and cost-effective. Another advantage may be that the statically charged customizable playing cards may be light and thus easy to shuffle and handle, while still providing a means for removably adhering the card components to one another. Another advantage is that the individual pieces or portions of the customizable playing cards may be easily and efficiently attached to and removed from one another without the need for moving or sliding the pieces in any particular direction or manner.

In another aspect, a customizable playing card is provided, comprising: a front card face; a back card face; a top card end; a bottom card end; a left lengthwise side; a right lengthwise side; a plurality of connectable surfaces, wherein each surface of the plurality of connectable surfaces is capable of being removably adhered to each other surface of the plurality of connectable surfaces via static electricity; a first card component; and a second card component that joins with the first card component via the static electricity to form the customizable playing card; the first card component having: a front first card component face; and a back first card component face; the second card component having: a front second card component face; and a back second card component face; wherein the first card component connects to the second card component such that the front first component face is visible and comprises the front card face; and such that the front second component face is opposite to the front first component face and is visible and comprises the back card face. Thus, again, an advantage is that a set of cards may be easily and efficiently changed, upgraded, or otherwise manipulated such that a user can alter their selection of cards without the need for purchasing additional cards or card parts. Another advantage may be that a user may more easily trade cards or card components with another user. Another advantage may be that the materials used to construct the customizable playing cards may be easily obtained and cost-effective. Another advantage may be that the statically charged customizable playing cards may be light and thus easy to shuffle and handle, while still providing a means for removably adhering the card components to one another. Another advantage is that the individual pieces or portions of the customizable playing cards may be easily and efficiently attached to and removed from one another without the need for moving or sliding the pieces in any particular direction or manner.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which:

FIGS. 5*a*-5*e* illustrate additional examples of vertical and horizontal magnetic pole alignments that may be used for attaching and detaching the various components of magnetic playing cards, according to an aspect.

FIG. 5*f* shows a front view of a card component substitute which may have a magnetically receptive material, according to an aspect.

FIGS. 6*a*-6*e* show examples of diagonal magnetic pole alignments for magnetic playing cards, that may be used for attaching and detaching the various components of magnetic playing cards, according to an aspect.

FIG. 6*f* shows a front view of a card component substitute which may have a magnetically receptive material, according to an aspect.

FIGS. 7*a*-7*e* show additional examples of diagonal magnetic pole alignments for magnetic playing cards, that may be used for attaching and detaching the various components of magnetic playing cards, according to an aspect.

FIG. 7*f* shows a front view of a card component substitute which may have a magnetically receptive material, according to an aspect.

FIGS. 8*a*-8*e* show an example of a horizontal magnetic pole alignment for magnetic playing cards that may be used for attaching and detaching the various components of magnetic playing cards, according to an aspect.

FIG. 8*f* shows a front view of a card component substitute which may have a magnetically receptive material, according to an aspect.

FIGS. 9*a*-9*e* show an example of a vertical magnetic pole alignment for magnetic playing cards, that may be used for attaching and detaching the various components of magnetic playing cards, according to an aspect.

FIG. 9*f* shows a front view of a card component substitute which may have a magnetically receptive material, according to an aspect.

FIGS. 11*a*-11*c* illustrate a perspective view of another example of customizable playing cards with interchangeable components, wherein each component can be provided in a variety of sizes, according to an aspect.

FIGS. 12*a*-12*c* illustrate front perspective views of customizable playing cards wherein the portions of the cards may be associated or attached together using an interlocking mechanism, according to an aspect.

DETAILED DESCRIPTION

Figures 1A, 1B, 1C, 1D, 1E, 1F, 1G:
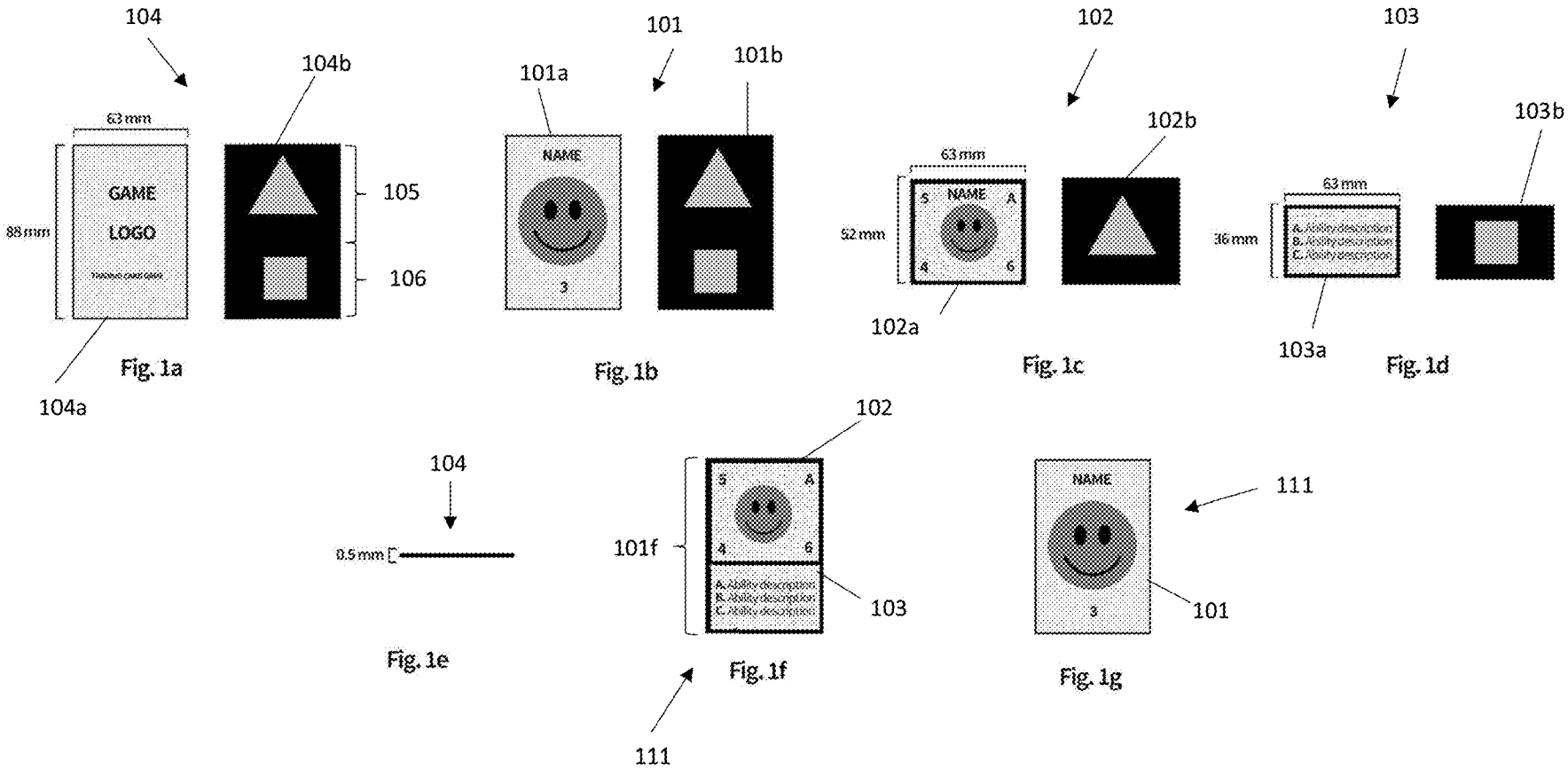
FIGS. 1*a-d* illustrate exemplary embodiments of magnetic playing cards with interchangeable components, wherein each component can be provided in a variety of sizes, according to an aspect.
FIG. 1*e* illustrates a side elevation view of a magnetic playing card first component 104, according to an aspect.
FIG. 1*f* illustrates a front view of a magnetic playing card in an assembled state, according to an aspect.
FIG. 1*g* illustrates a front view of another example of a magnetic playing card in an assembled state, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 102 and 202, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIGS. 1*a*-1*d* illustrate exemplary embodiments of magnetic playing cards ("magnetic playing cards," "interchangeable card," "playing card," "card") with interchangeable components ("interchangeable components," "card components," or "components"), wherein each component can be provided in a variety of sizes, according to an aspect. Magnetic playing cards may be provided with two components such as a first component 104 of FIG. 1*a* and a second component 101 of FIG. 1*b*, which may be combinable and may attach to each other via magnets or magnetic surfaces, to create an assembled magnetic playing card. A magnetic playing card may be comprised of two or more components attached together, for example. Each component of the magnetic playing may be provided with a front surface or face, and a back surface or face.

FIG. 1*a* illustrates a front side 104*a* and a back side 104*b* of an example of a first component 104 of an interchangeable card, according to an aspect. The back side 104*b* is shown with an upper section 105 and a lower section 106 as an example. The upper section 105 and the lower section 106 may each contain an illustration, or text, or both, for example. The first component 104 is shown with exemplary dimensions that the component may be provided in.

FIG. 1*b* illustrates a front side 101*a* and a back side 101*b* of an example of a second component 101 of an interchangeable card, according to an aspect.

FIG. 1*c* illustrates a front side 102*a* and a back side 101*b* of another example of a portion of a second component 102, according to an aspect. The portion of a second component 102 is shown with exemplary dimensions that the component may be provided in. The portion of the second component 102 may be an upper portion ("upper portion" or "first portion"), for example. The portion of the second component 102 may be combined with other portions in order to assemble a full second component.

FIG. 1*d* illustrates a front side 103*a* and a back side 103*b* of another example of a portion of a second component 103, according to an aspect. The portion of a second component 103 is shown with exemplary dimensions that the component may be provided in. The portion of the second component 103 may be a lower portion ("lower portion" or "second portion"), for example. Again, similar to FIG. 1*c*, the portion of a second component 103 may be combined with other portions, such as portion 102, to assemble a full second component.

It should be understood that a first portion and a second portion may be associated together in any suitable arrangement. For example, the first portion 102 may be an upper portion as shown, and the second portion 103 may be a lower portion as shown. However, the first portion may also be a left portion and the second portion may be a right portion, for example. The portions may also be arranged diagonally or in any other suitable fashion to create a full component of a card.

FIG. 1*e* illustrates a side elevation view of a magnetic playing card first component 104, according to an aspect. An exemplary thickness of 0.5 mm is provided as the thickness of a single card component. Each component of a magnetic playing card may be, for example, 0.5 mm as in the example shown, and it should be understood that various components of the magnetic playing card may be provided in varying thicknesses and other dimensions. Exemplary dimensions of a magnetic playing card are as follows. The assembled magnetic card having a first component combined with a second component may be approximately 0.8-1.5 mm in thickness. Each individual component, when separated from other components, may be approximately 0.4-0.75 mm in thickness. The assembled card may be approximately 88 mm in height and approximately 63 mm in width. The thickness, height, and width of the components may be primarily determined by providing a card with a suitable thickness and size for preventing tearing and other similar damage while still allowing the magnetic playing card to be inserted into a standard size protective card sleeve. An example of such a protective card sleeve is a sleeve manufactured by Ultra PRO™. A magnetic playing card may be provided with dimension that are ±1-3% of the above exemplary dimensions, and the provided dimensions may differ according to the material used for construction of the magnetic playing card.

FIG. if illustrates a front view of a magnetic playing card 111 in an assembled state, according to an aspect. From the front view, a second component 101*f*, having an upper portion 102 and a lower portion 103, may be visible, and a first component may be positioned behind the second component 101*f*, and the first component may not be visible in this view. The second component 101*f* may be assembled by combining the two portions 102 and 103, thus creating a full second component 101*f*. A magnetic playing card 111 may be assembled by combining the full second component 101*f* with a first component, for example.

FIG. 1*g* illustrates a front view of another example of a magnetic playing card 111 in an assembled state, according to an aspect. From the front view, a second component 101, having a single portion, may be visible, and a first component may be positioned behind the second component 101, and the first component may not be visible in this view. The second component 101 may be combined with or attached to the first component to create a magnetic playing card 111. Thus, the visible side of the second component 101 may comprise a front card face of the magnetic playing card, as an example. The opposite face of the magnetic playing card may be the back card face of the magnetic playing card.

It should be noted that each component (104, 101, 102, 103) may be comprised of one or more portions that may be joined together to form the component. As an example, the front side 104*a* of the first component 104 (as shown in FIG. 1*a*) and front side 101*a* of the second component 101 (as shown in FIG. 1*b*) both have one portion. As another example, the second component 101 of FIG. if may be made up of two portions, which may be the portions shown in FIGS. 1*c*-1*d*, the upper portion 102 and the lower portion 103. Such portions of a component may be equal or unequal in size. As an example, the upper portion 102 of the second component 101*f* may be larger than the lower portion 103. These portions may be provided with dimensions 63 mm by 52 mm, and 63 mm by 36 mm, respectively. In another example (not shown), the first portion and the second portion of the second component may be equal in size, both having the dimensions 63 mm by 44 mm.

It should also be understood that each component may be comprised of one or more sections within a single integral component, such that each section is provided with a different magnetic alignment. It should also be understood that each magnetized surface of each card component may be partially magnetized, or, the magnetized surface may comprise the entire surface of the card surface. As an example, a card surface may only be magnetized in its corner sections, or, as another example, the full surface of the card face may be magnetized. It should also be understood that the first card component and the second card component may be provided in any combination as described herein, having at least one or more sections that are magnetized, or being comprised of at least two or more portions that join together.

In an exemplary method of using the interchangeable cards, a player ("player" or "user") may attach the back side 104*b* of the first component 104 to the back side 101*b* of the second component 101 (that is, with the two back sides 104*b* and 101*b* facing each other), thus leaving the front sides of the first and second components (104*a* and 101*a*, respectively) visible. As will be discussed in greater detail hereinbelow, the front side of a component (104*a*, 101*a*, 102*a*, and 103*a* of FIGS. 1*a*, 1*b*, 1*c*, and 1*d*, respectively) may be printed with game information such as text, art, game logos, ability descriptions, and the like. The back side of a component (104*b*, 101*b*, 102*b*, and 103*b* of FIGS. 1*a*, 1*b*, 1*c*, and 1*d*, respectively) may be printed with a guide ("printed guide" or "guide") which may be a shape, instructions, or a combination thereof to indicate to a player or user a preferred orientation for attaching the components together. Each card component may include one printed guide or two or more printed guides.

As an example, each component (such as 101 and 104) of a magnetic playing card may be provided with two layers adhered together. One layer may be a magnetic material such as, for example, a flexible rubber material containing magnetized iron dust ("magnetized rubber," or "magnetized material"), and the second layer may be a thin, flexible material (such as vinyl, paper, plastic, and the like) which may be a printable material for displaying graphics, images, text, and so on ("printable material"). If a component is manufactured with two layers, the printable material layer may be the front side of the component (such as 104*a* of FIG. 1*a*) and the magnetized material layer may be the back side of the component (such as 104*b* of FIG. 1*a*).

As another example, each component (101 and 104) of a magnetic playing card may have three layers adhered together. One layer may be magnetized rubber, with the other two layers being printable material adhered to both sides of the magnetized rubber. In other words, the three layers may be one layer of magnetized rubber sandwiched between two printable material layers ("sandwich configuration"), thus enabling game information or images to be printed on both sides of the component. It should be noted that each layer of printable material may or may not be the same color and/or material. For example, both layers of printable material may be white vinyl such that both sides of the component would appear the same before printing. As another example shown by FIGS. 1*a*, 1*b*, 1*c*, and 1*d*, the front side of a component may be white vinyl (104*a*, 101*a*,

102*a*, and 103*a*, respectively) and the back side of the component may be black vinyl (104*b*, 101*b*, 102*b*, and 103*b*, respectively).

It should be noted that it is also an option to manufacture the first component with two layers and the second component with three layers, or vice versa. It should also be noted that non-magnetized rubber containing iron dust can be substituted for the magnetized rubber layer of a magnetic playing card, which may be advantageous because this may be attracted to any type of magnetic pole alignment, as will be disclosed in greater detail when referring to FIGS. 4*a*-4*f* Thus, a magnetic playing card may be provided having both magnetized and non-magnetized rubber. When a first component and a second component are provided wherein both pieces are magnetized, it may require that the two components be joined together in a very specific way. This may be advantageous for certain games that may require assembly of cards in a particular fashion. However, if only one of the two pieces is magnetized, then the two components may be joined by aligning the components in multiple ways.

The magnetized rubber may be manufactured and magnetized with a Halbach Array, which results in one side of a component having a strong magnetic field and the other side having a weak magnetic field. That is, a first side may have a first magnetic field, and a second side may have a second magnetic field that is weaker than the first magnetic field. The Halbach Array is known to those of ordinary skill in the art and is achieved by arranging permanent magnets in a spatially rotating pattern, thus the magnetic field is augmented on one side of the array and near zero on the other side. It may be preferable to manufacture components such that the side having the magnetized rubber with a strong magnetic field faces the back side 104*b*, 101*b* of the component and the side with a weak magnetic field faces the front side 104*a*, 101*a*. The card may also indicate to a player to attach the components in the orientation disclosed hereinbefore. The magnetic playing cards may be constructed such that before any printing is completed, the eye cannot differentiate the front side from the back side of a card component, despite the front side having a stronger magnetic field than the back side, or vice versa.

As an example, shown by FIG. 1*a*, the magnetic playing cards described herein may have the length and width of a standard playing card, which may be about 88 mm by 63 mm. Exemplary dimensions of a standard poker playing card are 88.9 mm×63.5 mm, and thus the magnetic playing cards may also be provided having these dimensions. However, it should be noted that the magnetic playing cards may be provided in a wide variety of dimensions, sizes, and shapes. For example, the magnetic playing cards can have a triangular shape with side lengths of 4 cm, or may be circular, with a radius of 4 cm, as will be further discussed when referring to FIGS. 10*a* and 10*b*. It should also be noted that the dimensions of the first component and the dimensions of the second component may differ from one another. For example, the first component of a magnetic playing card may be rectangular (such as 104 of FIG. 1*a*) and the second component may be triangular (such as 1001 of FIG. 10*a*) or circular (such as 1001' of FIG. 10*b*).

Descriptions of exemplary embodiments of possible magnetic playing cards follow herein. It should be noted that the below examples are not the only possible embodiments of a magnetic playing card and additional embodiments are also possible.

What follows is a description of a first example (Example 1) of a magnetic playing card assembly, referring to FIGS. 1*a*, 1*b*, and 1*g*. A magnetic playing card is provided, having a first component 104 and a second component 101, each with one portion. The magnetic playing card is manufactured with each component having three layers in a sandwich configuration, as described hereinbefore. The first component 104 and the second component 101 both have the dimensions 63 mm by 88 mm. The front side 104*a* of the first component 104 has a game logo and the name of a trading card game printed on white vinyl or another appropriate or suitable printable material. The front side 101*a* of the second component 101 has a character name, artwork, and point value printed on white vinyl or other suitable printable material. The back sides of the first and second components 104*b* and 101*b* have a triangle and a square printed on black vinyl or another appropriate printable material. These shapes printed on the back sides 104*b*, 101*b* of the components, together with the Halbach Array, indicate to the player the preferred orientation for attaching the back side 104*b* of the first component 104 and the bac side 101*b* of the second component 101 together. For example, a user may be instructed to join a section printed with a triangle with another card having a section printed with a triangle, and join a section printed with a square with another card having a section printed with a square, and so on. As an example, when the first card component is provided with two or more sections, the back face of the first card component may be provided with a first printed guide denoting the first direction and a second printed guide denoting the second direction, thus signaling or guiding the user a desired method of assembling the card components together. This example of a magnetic playing card is shown assembled in the preferred orientation in FIG. 1*g*. In other words, the back sides of the first and second components (104*b* and 101*b*, of FIGS. 1*a* and 1*b*, respectively) are attached together.

It should be understood that each face or side of the various components of the magnetic trading card may be provided with any words, logos, images, text, illustrations, decorative elements, or any other suitable printed matter, or any combination of printed matter ("card print matter," "print matter," "card images," "card text," or "card logo"). The designs or other elements provided on the card may be referred to as "card print matter." The card print matter may be illustrations or text related to a card game, or may be instructions for a user related to the assembly of the card components, as examples.

What follows is a description of a second example (Example 2) of a magnetic playing card assembly, referring to FIGS. 1*a*, 1*c*, 1*d*, and 1*f*. A magnetic playing card is provided, having a first component 104 and a second component 101*f*. The first component 104 is made up of one portion and the second component 101*f* is made up of two portions 102 and 103, and the magnetic playing card assembly is manufactured with each component having three layers in the sandwich configuration, as described hereinbefore. The first component 104 has the dimensions 63 mm by 88 mm, as shown by FIG. 1*a*. The first portion 102 of the second component 101*f* has the dimensions 63 mm by 52 mm and the second portion 103 of the second component 101*f* has the dimensions 63 mm by 36 mm, as shown by FIGS. 1*c* and 1*d*, respectively. The front side 104*a* of the first component 104 may have a game logo and the name of a trading card game printed on white vinyl or another appropriate or suitable printable material. The front side 102*a* of the first portion 102 of the second component 101*f* has a character name, artwork, and point value printed on white vinyl or another appropriate printable material. The front side 103*a* of the second portion 103 of the second component 101*f* has ability descriptions printed on white vinyl or another appropriate printable material. The back side 104*b* of the first component 104 has a triangle and a square printed on black vinyl or another appropriate printable material, as shown in FIG. 1*a*. The back side 102*b* of the first portion of the second component 102 may have a triangle printed on black vinyl or another appropriate printable material, and the back side 103*b* of the second portion of the second component 103 may have a square printed on black vinyl or another appropriate printable material, as shown by FIGS. 1*c* and 1*d*, respectively. The shapes printed on the back sides of the components, together with the Halbach Array, indicate to the player a preferred orientation for attaching the first and second components together. This example of a magnetic playing card is shown in an assembled state in FIG. 1*f*. In other words, the back sides of the first and second components (104*b*, 102*b*, and 103*b*, of FIGS. 1*a*, 1*c*, and 1*d*, respectively) are attached together and facing each other. The back side 102*b* of the first portion 102 of the second component 101*f* is aligned with and attached to the upper section 105 of the back side 104*b* of the first component 104. The back side 103*b* of the second portion 103 of the second component 101*f* is aligned with and attached to the lower section 106 of the back side 104*b* of the first component 104.

What follows is a description of a third example (Example 3) of a magnetic playing card assembly, again referring to FIGS. 1*a*, 1*c*, 1*d*, and 1*f*. A magnetic playing card is provided as in Example 1, having a first component and a second component, with each component having one portion, and manufactured with each component having three layers in a sandwich configuration. The first component 104 has the dimensions 63 mm by 88 mm. In this example, the lower section 106 of the first component 104 is permanently adhered to the portion of a second component 103 of FIG. 1*d* ("permanent assembly"), thus creating an apparent need for a player to attach the permanent assembly to the upper section 105 of the first component 104. The remaining portion of the second component is 102 of FIG. 1*c*, having the dimensions 63 mm by 52 mm. In this example, the front side 104*a* of the first component 104 may have a game logo and the name of a trading card game printed on white vinyl or another appropriate printable material. The front side 102*a* of the portion of the second component 102 has a character name, artwork, and point value printed on white vinyl or another appropriate printable material. In this example, the back side 104*b* of the first component has a triangle printed on the upper section 105 and ability descriptions printed on the lower section 106 on black vinyl or another appropriate printable material. The back side 102*b* of the second component 102 has a triangle printed on black vinyl or another appropriate printable material. The triangles printed on the back sides of the provided components, together with the Halbach Array, indicate to the player the preferred orientation for attaching the first and second components together. This example of a magnetic playing card is shown in an assembled state in FIG. 1*f*. In other words, the back sides of the first and second components are attached together such that the back side of the second component 102*b* is attached to the upper section 105 of the back side of the first component 104*b*.

Magnetic playing cards matching the examples discussed will be referred to hereinafter as "Example 1," "Example 2," and "Example 3" magnetic playing cards.

FIGS. 2*a*-2*e* illustrate examples of how various magnetic playing card components and portions may be attached, detached, and interchanged with each other, according to an aspect. The magnetic playing card components disclosed hereinbefore when referring to FIGS. 1*a*-1*f* may be attached, detached, and interchanged with each other in various ways.

Figure 2A:
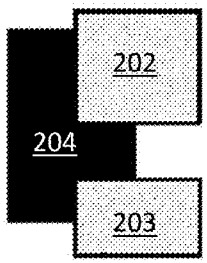
FIGS. 2*a*-2*e* illustrate examples of how various magnetic playing card components and portions may be attached, detached, and interchanged with each other, according to an aspect.
Figure 2B:
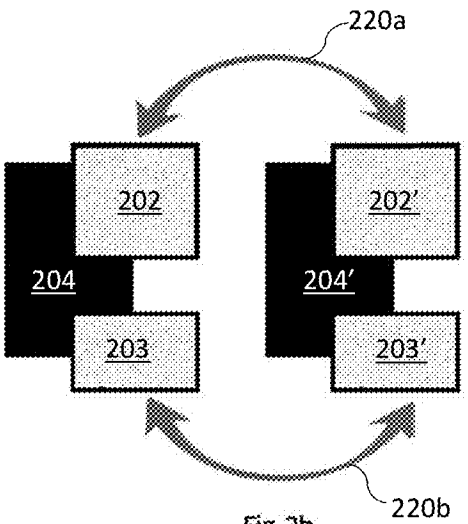
Figure 2C:
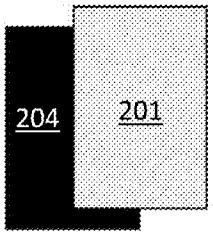

FIG. 2*c* shows how the second component 101 may be associated with and also detached from the first component 104 of an Example 1 magnetic playing card.

Figure 2D:
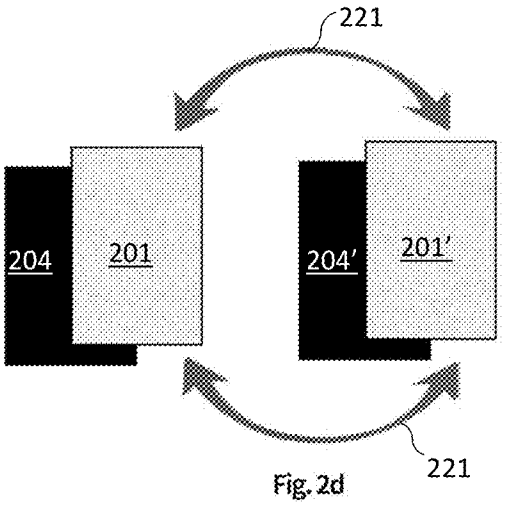

FIG. 2*d* shows two similar Example 1 magnetic playing cards. In FIG. 2*d*, arrows 221 indicate that the second components (201 and 201') of the Example 1 magnetic playing cards may be interchanged with and attached to multiple first components 204 and 204'. In other words, a player can swap the second components of different magnetic playing cards.

Similarly, FIG. 2*a* shows how the first and second portions 202 and 203 may be detached from the first component 104 of an Example 2 magnetic playing card. Arrow 220*a* of FIG. 2*b* indicates that the first portions 202 and 202' of the second component of multiple Example 2 magnetic playing cards may be interchanged. Arrow 220*b* indicates that the second portions 203 and 203' of the second component may be interchanged with and attached to different first components 204 and 204'. In other words, a player can mix and match the first and second portions 202 and 203 of second components to form many different card combinations.

Figure 2E:
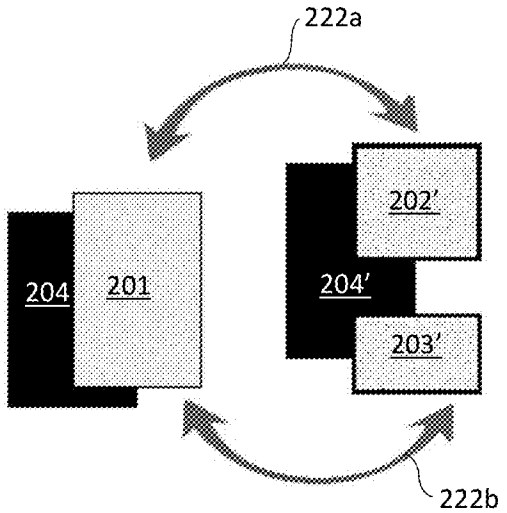

In FIG. 2*e*, arrows 222*a* and 222*b* indicate that the second component 201 of an Example 1 magnetic playing card and the first and second portions 202' and 203' of the second component of an Example 2 magnetic playing card can be interchanged.

The ability to swap card components and portions allows player to customize their playing cards in many ways. Another advantage may be that many different card combinations are possible.

Figure 3B:
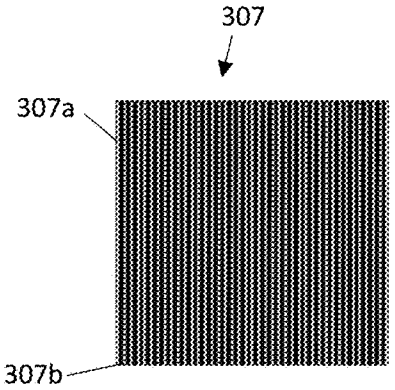
FIGS. 3*a*-3*b* illustrate exemplary magnetic pole spacing and alignments, according to an aspect.
Figure 3A:
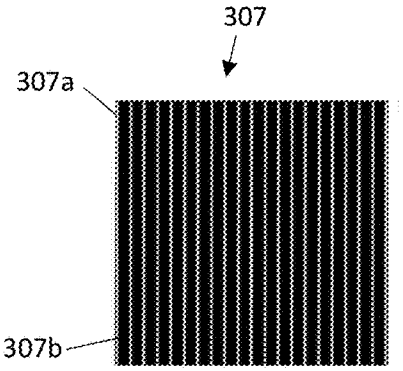

FIGS. 3*a*-3*b* illustrate exemplary magnetic pole spacing and alignments, according to an aspect. Specific magnetic pole alignments can be created during the manufacturing process of the magnetized rubber layer of the components. As shown in FIGS. 3*a* and 3*b*, the magnetic poles 307, represented by white lines in this figure and in the following figures, are shown to have a vertical alignment. The magnets may alternate, such that, for example, the pole at the top end 307*a* is north, and the next magnet is south, and the next is north, and so on. The poles of the bottom end 307*b* may be the opposite of the top end 307*a*. It should be understood that the magnetic poles as represented by 307 and represented throughout the figures may be provided in an alternating arrangement as described, such that a north pole is followed by a south pole, and so on. As an example, the poles 307 of FIGS. 3*a*-3*b* run vertically from the top end 307*a* to the bottom end 307*b* of the card components shown. An exemplary arrangement of magnets is 16 poles per inch, such that each magnet pole is $1/16^{th}$ of an inch apart. Another exemplary arrangement is $1/8^{th}$ of an inch spacing, which may be magnetically weaker than the $1/16^{th}$ of an inch spacing, but an advantage may be that children or others with a weaker grip or smaller hands may find the magnetic cards easier to align and assemble when a $1/8^{th}$ of an inch spacing is provided.

The spacing of the magnets may vary; that is, the width of each magnet may be an eighth of an inch as shown in FIG. 3*a*, or a sixteenth of an inch as shown in FIG. 3*b*. The arrangement of the magnets may be established during the manufacturing process. As an example, the width of each magnet in a set or provided assembly of magnetic playing cards may be approximately the same, such that the various components of the magnetic playing cards can easily be associated with each other.

The methods used to manufacture the magnetized rubber layer of magnetic playing cards with specific magnetic pole alignments is known to those of ordinary skill in the art. One method that may be used is by rolling a magnetizer made up of opposite-facing ring magnets over the material. Having specific magnetic pole alignments may help components slide along the direction of the magnetic pole alignment. For example, if two components have vertical magnetic pole alignments, as shown in FIGS. 3*a* and 3*b*, they may be capable of sliding vertically against each other when attached. An advantage may be that this can serve as another way to indicate to a player the intended orientation for attaching card components, because it would be difficult to attach a component with a vertical magnetic pole alignment to a component with a horizontal magnetic pole alignment.

FIGS. 4*a*-4*e* show examples of vertical and horizontal magnetic pole alignments that may be used for attaching and detaching the various components of magnetic playing cards, according to an aspect. The horizontal alignment of the magnets may, for example, be provided such that the magnets of the upper section 405 are vertical (perpendicular with the top end and bottom end of the magnetic playing card), and the magnets of the lower section 406 are horizontal (parallel with the top and bottom ends of the magnetic playing card). Thus, the magnetic alignments provided may bias the association of the card components together along the directions of the magnetic alignments (such as, for example, along a horizontal direction in 406, or along a vertical direction in 405).

Figure 4F:
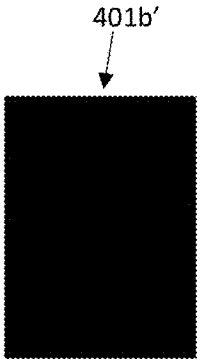
FIG. 4*f* shows a front view of a card component substitute which may have a magnetically receptive material, according to an aspect.
Figure 4E:
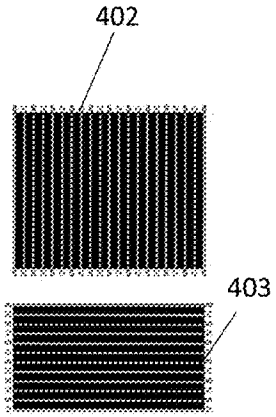
FIGS. 4*a*-4*e* show examples of vertical and horizontal magnetic pole alignments that may be used for attaching and detaching the various components of magnetic playing cards, according to an aspect.
Figure 4D:
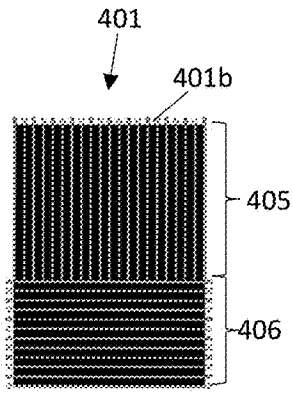
Figure 4C:
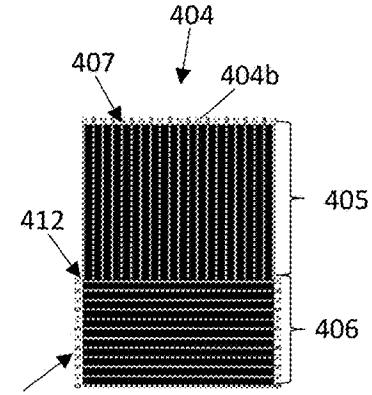
Figure 4B:
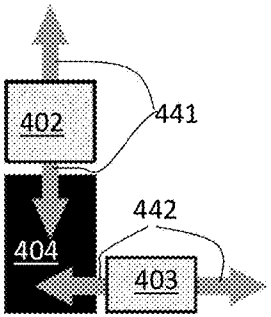
Figure 4A:
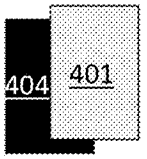

FIG. 4*a* shows how the second component 401 may be detached from the first component 404 of an Example 1 magnetic playing card. FIG. 4*b* shows that two second components, a first portion 402 and a second portion 403, can be combined with a first component 404 via the magnetic surfaces of each component, to assemble a second component 501 of a magnetic playing card. The alignments of the magnetic poles on the surfaces of the components may bias each portion into easily moving only in certain directions, thus indicating to the user a desired orientation of attaching the card components together.

The first portion 402 may be biased to slide in the directions indicated by arrows 441, which may be up-and-down directions, to attach to the upper section 405 of the first component 404, and the second portion 403 may be biased to slide in the directions indicated by arrows 442, which may be side-to-side directions, to attach to the lower section 406 of the first component 404. Together, when moved into position, the first portion 402 and the second portion 403 may become a second component, such as the second component 401 shown in an assembled state in FIG. 4*d*.

Each card component may be provided with a magnetic surface. FIGS. 4*c*, 4*d*, and 4*e* show an exemplary magnetic pole alignment on surfaces of card components. The magnetic surface may be, for example, on the back side 404*b* of the first component 404, and on the back side 401*b* of the second component 401. A magnetic playing card may be assembled by attaching the magnetic surfaces of card components together. As shown by FIGS. 4*c*-4*d*, the magnetic pole alignments of card components may be similar, such that two card surfaces may be associated with each other. As an example, the upper sections 405 of both the first component 404 and the second component 401 may have a vertical magnetic pole alignment, wherein the magnetic poles 407 of the magnets alternate left to right from north pole to south pole, while the lower sections 406 of both the first component 404 and the second component 401 may have a horizontal magnetic pole alignment, wherein the magnetic poles 407 of the magnets alternate top to bottom from north pole to south pole.

FIG. 4*e* illustrates that the two portions 402 and 403 may be provided separately from each other, and may be associated together by a user when assembling a magnetic card. It should be understood that the portions 402 and 403 may also be provided in association with each other, wherein the portions are integral to each other.

FIG. 4*f* shows a front view of a card component substitute 401*b*' which may have a magnetically receptive material ("magnetically receptive material," or "receptive material"), according to an aspect. The receptive material may, for example, be non-magnetized rubber mixed with iron dust, and may be used for attaching to a magnetic surface, as will be further described herein.

FIGS. 5*a*-5*e* illustrate additional examples of vertical and horizontal magnetic pole alignments that may be used for attaching and detaching the various components of magnetic playing cards, according to an aspect.

FIG. 5*f* shows a front view of a card component substitute 501*b*' which may have a magnetically receptive material, according to an aspect.

Again, similar to the magnetic card assembly shown in FIGS. 4*a*-4*f*, FIGS. 5*a*-5*f* show various components that can be associated together to assemble magnetic playing cards.

FIG. 5*a* shows how the second component 501 may be detached from the first component 504 of an Example 1 magnetic playing card. FIG. 5*b* shows that two second components, a first portion 502 and a second portion 503, can be combined with a first component 504 via the magnetic surfaces of each component, to assemble a second component 501 of a magnetic playing card. Again, the alignments of the magnetic poles on the surfaces of the components may bias each portion into easily moving only in certain directions, thus indicating to the user a desired orientation of attaching the card components together.

The first portion 502 may be biased to slide in the directions indicated by arrows 542, which may be side-to-side directions to attach to the upper section 505 of the first component 504, and the second portion 503 may be biased to slide in the directions indicated by arrows 541, which may be up-and-down directions, to attach to the lower section 506 of the first component 504. Again, similar to the magnetic card assembly described when referring to FIGS. 4*a*-4*f*, together, when moved into position, the first portion 502 and the second portion 503 may become a second component, such as the second component 501 shown in an assembled state in FIG. 5*d*.

FIG. 5*e* illustrates that the two portions 502 and 503 may be provided separately from each other, and may be associated together by a user when assembling a magnetic card. It should be understood that the portions 502 and 503 may also be provided in association with each other, wherein the portions are integral to each other.

FIG. 5*f* shows a front view of a card component substitute 501*b*' which may have a magnetically receptive material, according to an aspect.

This exemplary magnetic pole alignment may be used for constructing an Example 2 magnetic playing card. An advantage may be that the first portion 502 may not be easily dislodged during placement of the magnetic card into a card sleeve, due to the horizontal alignment or magnetic poles. Thus, while moving a magnetic card up and down into or out of a card sleeve, some of the magnetic components may be discouraged from moving in these directions, and may thus remain attached to one another. Providing the second portion 503 as in the examples shown in FIGS. 5*a*-5*e* may also be advantageous because the vertical magnetic pole alignment may prevent a player's thumb from accidentally dislodging the second portion when a player is holding the card.

FIGS. 6*a*-6*e* show examples of diagonal magnetic pole alignments for magnetic playing cards, that may be used for attaching and detaching the various components of magnetic playing cards, according to an aspect.

FIG. 6*f* shows a front view of a card component substitute 601*b*' which may have a magnetically receptive material, according to an aspect.

FIG. 6*a* shows how the second component 601 may be detached from the first component 604 of a magnetic playing card. FIG. 6*b* shows that two second components, a first portion 602 and a second portion 603, can be combined with a first component 604 via the magnetic surfaces of each component, to assemble a second component 601 of a magnetic playing card. Again, the alignments of the magnetic poles on the surfaces of the components may bias each portion into easily moving only in certain directions, thus indicating to the user a desired orientation of attaching the card components together.

The first portion 602 may be biased to slide in the directions indicated by arrows 661, which may be bottom left to upper right diagonal directions to attach to the upper section 605 of the first component 604, and the second portion 603 may be biased to slide in the directions indicated by arrows 662, which may upper left to bottom right diagonal directions, to attach to the lower section 606 of the first component 604. Again, similar to the magnetic card assembly described when referring to FIGS. 4*a*-4*e* and FIGS. 5*a*-5*e*, together, when moved into position, the first portion 602 and the second portion 603 may become a second component, such as the second component 601 shown in an assembled state in FIG. 6*d*.

As shown in FIG. 6*c*, the lower section 606 of the first component 604 may be provided with a diagonal magnetic pole alignment from the top left to the bottom right, wherein the magnetic poles 607 alternate left to right from south pole to north pole while the upper section 605 of the first component 604 is provided with an opposite diagonal magnetic pole alignment from the bottom left to the top right with the magnetic poles 607 alternating left to right from south pole to north pole. As shown in FIG. 6*e*, the and the first portion 602 of the second component may have a diagonal magnetic pole alignment from the top left to the bottom right with the magnetic poles alternating left to right from north pole to south pole. The magnetic playing card may be, for example, an Example 2 magnetic playing card.

The receptive material as shown in FIGS. 4*f*, 5*f*, and 6*f* may, for example, be non-magnetized rubber mixed with iron dust, and may be used for attaching to a magnetic surface. The card component substitute 401*b*', 501*b*', 601*b*' may adhere to any type of pole alignment, and thus may be used as a substitute for a card front or card back. The non-magnetized rubber may be substituted for the magnetized rubber layer of the second component 401*b*', 501*b*', 601*b*', or any other portion of the magnetic card, allowing the second component 401*b*', 501*b*', 601*b*' to be attached to any magnetic pole alignment. Thus, the user can use the card component substitute 401*b*', 501*b*', 601*b*' as an additional game piece, or as a placeholder, or as a substitute component, such as if matching game pieces is difficult or if a game piece is missing or lost.

By providing both the first component 404, 504, 604 and the second component 401, 501, 601 with similar magnetic pole alignments, the user can be easily guided when assembling the magnetic playing card. When sliding the upper portion 402, 502, 602 onto the first component 404, 504, 604, the upper portion 402, 502, 602 may easily slide until reaching the ending of the magnetic pole alignment section, which may be where a different pole alignment begins. The point at which the alignment of the magnetic poles may change to a different alignment may be a stopping point for a portion of a card component, and the stopping point is indicated by 412, 512, 612. When a portion 402, 502, 602 is pushed downwards onto the first component 404, 504, 604, the portion 402, 502, 602 may be biased to be moved easily until it reaches the stopping point 412, 512, 612. Because of the change in magnetic pole alignment, the portion 402, 502, 602 may no longer be easily moved, or may be biased against further movement, due to the properties of the magnets in the lower section 406, 506, 606. The upper section 405, 505, 605 and the lower section 406, 506, 606 may be conducive to movements in different directions by the separate portions. For example, the first portion 402 may be guided in up-and-down directions as indicated by arrows 441, while the second portion 402 may be guided in side-to-side directions as indicated by arrows 442, and the first portion 402 may be discouraged from moving in side-to-side directions and the second portion 403 may be discouraged from moving in up-and-down directions. Thus, the orientation, alignments, and arrangements of the magnets may help to guide the various game components into a desired position or assembly or help a user to more easily assemble the components into a magnetic card.

It should be understood that the magnetic alignments of separate sections of a component (such as the upper section 505 and the lower section 506 of FIGS. 5*c*-5*d* may be provided in various ways, such as, for example, providing a diagonal alignment in the upper section 505 and a horizontal alignment in the lower section 506, or any other suitable combination.

FIGS. 7*a*-7*e* show additional examples of diagonal magnetic pole alignments for magnetic playing cards, that may be used for attaching and detaching the various components of magnetic playing cards, according to an aspect.

FIG. 7*f* shows a front view of a card component substitute 701*b*' which may have a magnetically receptive material, according to an aspect. The non-magnetized rubber may be substituted for the magnetized rubber layer of the second component 701*b*', allowing the second component 701*b*' to be attached to any magnetic pole alignment.

FIG. 7*a* shows how the second component 701 may be detached from the first component 704 of a magnetic playing card. The second component 701 may be biased to be associated with the first component 704 in a diagonal direction, such as in the directions indicated by arrows 761.

In FIG. 7*b*, arrows 761 indicate that the first portion 702 and the second portion 703 of the second component of an Example 2 magnetic playing card may slide diagonally from the bottom left to the top right to attach to the first component, and thereby creating a second component. Again, the magnetic pole alignments provided with the card components may be helpful in indicating to the user a desired orientation of attaching the card components together.

As shown in FIG. 7*c*, the first component 704 may have a diagonal magnetic pole alignment from the bottom left to the top right with the magnetic poles 707 alternating left to right from south to north. As shown in FIG. 7*e*, the first portion 702 of the second component has a diagonal magnetic pole alignment from the top left to the bottom right with the magnetic poles alternating left to right from north to south of an Example 2 magnetic playing card. The second portion 703 may have the same magnetic pole alignment as the first portion 702 and the poles alternate left to right from south to north.

The magnetic poles of the second component 701*b* of an Example 1 magnetic playing card may be aligned in multiple ways, two of which are shown by FIGS. 7*d* and 7*f*. In one example shown in FIG. 7*d*, the second component 701 has a diagonal magnetic pole alignment from the top left to the bottom right with the magnetic poles 707 alternating left to right from north to south.

FIGS. 8*a*-8*e* show an example of a horizontal magnetic pole alignment for magnetic playing cards that may be used for attaching and detaching the various components of magnetic playing cards, according to an aspect.

FIG. 8*f* shows a front view of a card component substitute 801*b*' which may have a magnetically receptive material, according to an aspect.

In FIG. 8*a*, arrows 842 indicate that the second component 801 of an Example 1 magnetic playing card may slide horizontally (in side-to-side directions) to attach to the first component 804. In FIG. 8*b*, arrows 842 indicate that the first portion 802 and the second portion 803 of the second component of an Example 2 magnetic playing card may also slide horizontally (in side-to-side directions) to attach to the first component 804.

As shown in FIG. 8*c*, the first component 804 may have a horizontal magnetic pole alignment with the magnetic poles 807 alternating top to bottom from south to north. As shown in FIG. 8*e*, the first portion 802 and the second portion 803 of the second component may have a horizontal magnetic pole alignment with the magnetic poles alternating top to bottom from north to south of an Example 2 magnetic playing card.

The magnetic poles of the second component 801 of an Example 1 magnetic playing card may be aligned in multiple ways, two of which are shown by FIGS. 8*d* and 8*f*. In one example shown in FIG. 8*d*, the second component 801 may have a horizontal magnetic pole alignment with the magnetic poles alternating top to bottom from north to south. As another example shown by FIG. 8*f*, non-magnetized rubber may be substituted for the magnetized rubber layer of the second component 801*b*', allowing the second component 801*b*' to be attached to any magnetic pole alignment.

The magnetic pole alignment shown as an example FIGS. 8*c*-8*e* may be advantageous because the horizontal alignment may prevent the first portion 802 from being dislodged while in a card sleeve. This magnetic pole alignment may also be easier to manufacture than the alignment disclosed when referring to FIG. 5*a*-5*f*, for example. Manufacturers, such as Magnum Magnetics™, that produce the raw material for magnets (magnetized rubber with vinyl adhered to one or both sides) may, during their manufacturing process, magnetize an entire large-scale product (such as a 100-foot roll of material), and magnetize this product in one continuous direction. Therefore, to create magnetic cards having the magnetic pole alignments as shown in FIGS. 5*c*-5*e*, it may be necessary to carry out a separate and secondary magnetization process target only a portion of the card components. Thus, an advantage of a single alignment being used throughout a magnetic playing card could be that costs and labor are saved. However, an advantage of two different alignments being used for a magnetic playing card could be that the card may be resistant to breaking apart or the components becoming loose as a result of lateral thumb or finger movements during use of the cards, or as a result of inserting the card into or removing the card from a card sleeve.

FIGS. 9*a*-9*e* show an example of a vertical magnetic pole alignment for magnetic playing cards, that may be used for attaching and detaching the various components of magnetic playing cards, according to an aspect.

FIG. 9*f* shows a front view of a card component substitute 901*b*' which may have a magnetically receptive material, according to an aspect.

In FIG. 9*a*, arrows 941 indicate that the second component 901 of an Example 1 magnetic playing card may slide vertically (in up-and-down directions) to attach to the first component 904. In FIG. 9*b*, arrows 941 indicate that the first portion 902 and the second portion 903 of the second component of an Example 2 magnetic playing card may both slide vertically (in up-and-down directions) to attach to the first component 904.

As shown in FIG. 9*c*, the first component 904 may have a vertical magnetic pole alignment with the magnetic poles 907 alternating left to right from south to north. As shown in FIG. 9*e*, the first portion 902 and the second portion 903 of the second component have a vertical magnetic pole alignment with the magnetic poles alternating left to right from north to south of an Example 2 magnetic playing card.

The magnetic poles of the second component 901 of an Example 1 magnetic playing card may be aligned in multiple ways, two examples of which are shown by FIGS. 9*d* and 9*f*. In one example shown in FIG. 9*d*, the second component 901 may have a vertical magnetic pole alignment with the magnetic poles alternating left to right from north to south. As another example shown by FIG. 9*f*, non-magnetized rubber may be substituted for the magnetized rubber layer of the second component 901*b*', allowing the second component 901*b*' to be attached to any magnetic pole alignment.

Again, as discussed when referring to FIGS. 4*f*, 5*f*, and 6*f*, the card component substitute 701*b*', 801*b*', and 901*b*' may be used in association with any other card components in order to assemble a magnetic playing card. The card component substitute 701*b*', 801*b*', 901*b*' may take the place of one or more other card components, for example.

Figure 10B:
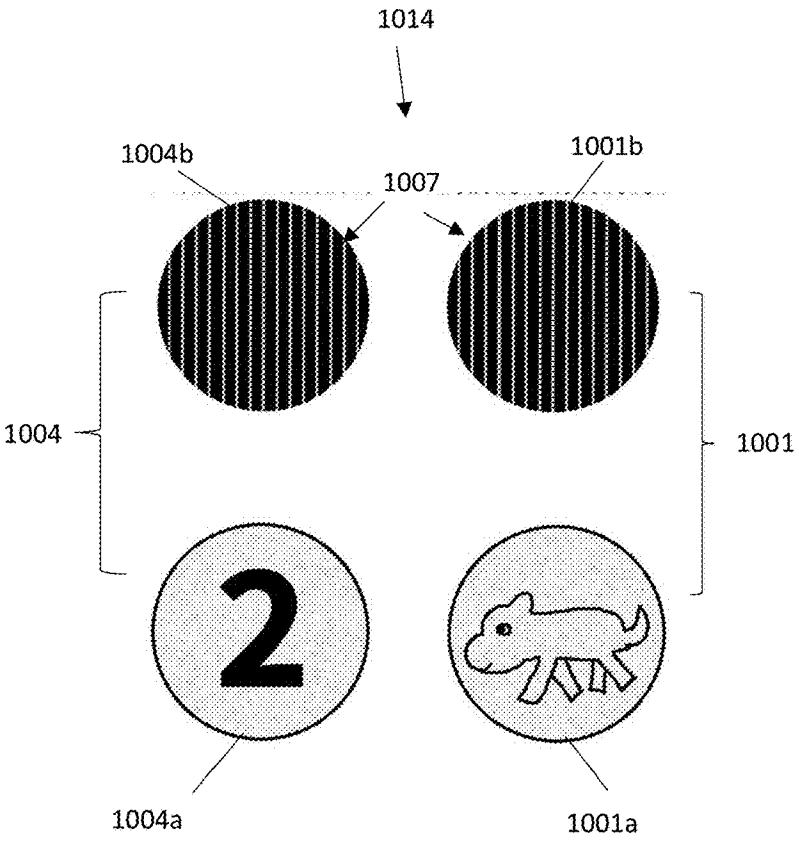
FIGS. 10*a*-10*b* illustrate examples of components of a triangular magnetic playing card and components of a circular magnetic playing card, respectively, according to an aspect.
Figure 10A:
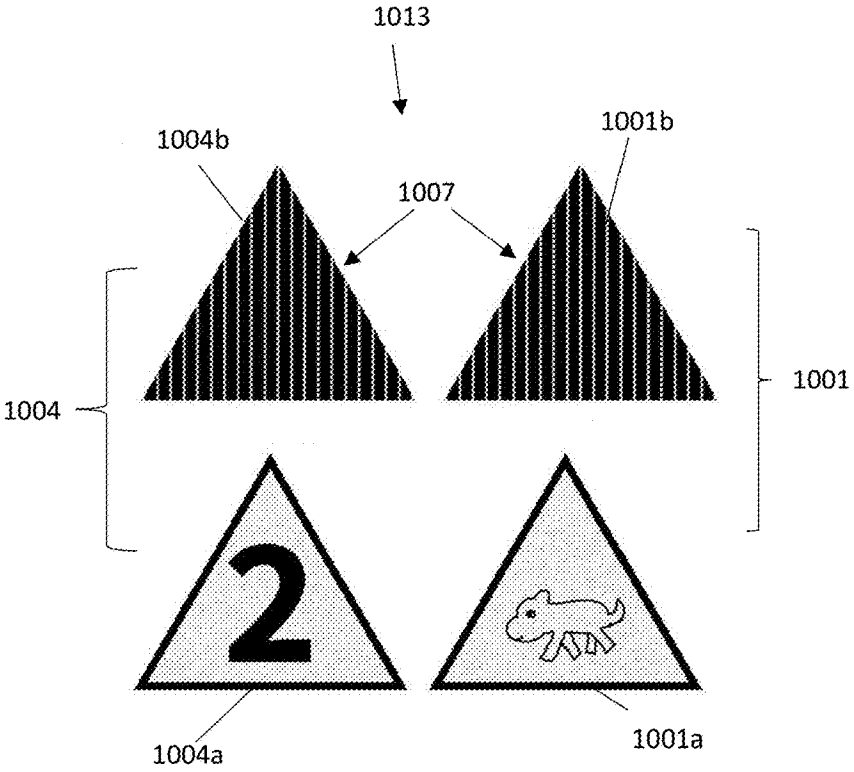

FIGS. 10*a*-10*b* illustrate examples of components of a triangular magnetic playing card 1013 and components of a circular magnetic playing card 1014, respectively, according to an aspect. As discussed hereinbefore, magnetic playing cards may be provided in a variety of shapes and sizes, such as in the examples shown, or in any other suitable shapes and sizes. FIG. 10*a* illustrates an example of a triangular magnetic playing card 1013 having two triangular components, which may be a first component 1004 and a second component 1001. The components may have vertical magnetic pole alignments as shown by the magnetic poles 1007 when viewed from the back side of the components (1004*b* and 1001*b*). In this example, the triangular magnetic playing card 1013 may be manufactured with two layers, as described when referring to FIGS. 1*a*-1*g*. The first component 1004 may have a point value printed on white vinyl and the second component 1001 may have artwork printed on white vinyl, as an example, or, the components may be printed with any other text, image, or decorative element.

FIG. 10*b* illustrates an example of a magnetic playing card 1014 with two circular components, wherein the first component 1004 and the second component 1001 are provided with vertical magnetic pole alignments, shown by the magnetic poles 1007 when viewed from the back side of the components (1004*b* and 1001*b*). In this example, the circular magnetic playing card may be manufactured with two layers, as described when referring to FIG. 1*a*-1*g*. The first component 1004 may have a point value printed on white vinyl and the second component 1001 may have artwork printed on white vinyl, or, again, or, the components may be printed with any other text, image, or decorative element.

FIGS. 11*a*-11*c* illustrate a perspective view of another example of customizable playing cards having interchangeable components, wherein each component can be provided in a variety of sizes, according to an aspect. It should be noted that, hereinafter, the terms "interchangeable playing card," "interchangeable card," "playing card," and "card" as well as other terms disclosed when referring to FIGS. 11*a*-19*d* relate to the customizable playing cards shown and described when referring to FIGS. 11*a*-19*d*, unless otherwise stated. The customizable playing cards shown and described when referring to FIGS. 11*a*-19*d* may be constructed from materials such as cardboard and plastic. An advantage may be that the cost of construction of the cards may be low or affordable, and thus, may lower the price of the cards.

Similar to the magnetic playing cards shown and described when referring to FIGS. 1*a*-10*b*, the customizable playing cards disclosed when referring to FIGS. 11*a*-19*d* may be provided with a plurality of components, such as two components, which may be a first component 1174 of FIG. 11*a* and a second component. The second component is shown by 1171*f* in FIG. 11*c* as an example, wherein the second component 1171*f* is created by combining piece A (shown by 1172 in FIG. 11*b*) and piece B (shown by 11732 in FIG. 11*b*). The pieces A and B may be combined or attached together by any suitable method, such as the methods described in further detail hereinafter.

Each customizable playing card may be constructed by combining any suitable number of pieces ("pieces," or "portions"), such as the example portions "A," "B," and "C" shown in FIGS. 11*a*-19*d*, which represent examples of individual pieces or portions of the playing card, or playing card components. Each component and portion of a customizable playing card may be provided with a front surface ("front surface," or "front face,") and a back surface ("back surface," "rear surface," "rear face,") or "back face"). It should be understood that only the front face or the rear face of each piece or component may be visible in the views shown as examples in FIGS. 11*a*-19*d*.

It should be understood that the components and portions of the customizable playing cards shown and described when referring to FIGS. 11*a*-19*d* may be provided in similar exemplary sizes, may be swapped and traded, and may be combined in the same exemplary orientations and arrangements as the magnetic playing cards disclosed hereinbefore when referring to FIGS. 1*a*-10*b* It should also be understood that the components of a customizable playing card may have the same exemplary content, such as artwork, text, symbols, game instructions, and so on, printed on the front face and back face as a magnetic playing card. Additionally, it should be understood that the methods used to construct, attach, and secure the components and portions of the customizable playing cards disclosed when referring to FIGS. 11*a*-19*d* may be similar to or differ from the methods used to construct and attach the components and portions of the magnetic playing cards disclosed when referring to FIGS. 1*a*-10*b*.

FIG. 11*a* illustrates an example of customizable playing card in an unassembled state, according to an aspect. The customizable playing card shown may be provided with three portions: portion A 1172, portion B 1173, and component C 1174, where, again, "A," "B," and "C" represent examples of individual pieces, portions, or components of the playing card. The back face of the first component 1174 and the front faces of the first portion 1172 and second portion 1173 of a second component may be visible in this view. Components may be provided in a full size, such as example component C 1174, or in partial sizes, such as the example components A 1172 and B 1173. Portions of partial sizes may be combined together to form a full size component, for example. The first portion 1172 and the second portion 1173 may be associated together to form a full size second component 1171*f* of FIG. 11*c*. It should be understood that a first component or a second component may be made up of one portion or a plurality of portions.

FIG. 11*b* illustrates an example of a customizable playing card in a partially assembled state, showing an exemplary manner of assembly of the customizable playing card, according to an aspect. The second portion 1173 of a second component is shown being associated with a first component 1174, while the first portion 1172 of the second component is being slidably associated with the first component 1174, such that the first component 1174 is partially visible.

FIG. 11*c* illustrates the customizable playing card of FIG. 11*b* in a fully assembled state ("assembled playing card," "assembled card") 1170, according to an aspect. As an exemplary playing card configuration, hereinafter referred to as "Example A," the assembled playing card 1170 may comprise a first component (not visible in FIG. 11*c*, and partially visible and shown by 1174 in FIG. 11*b*) attached to a full size second component 1171*f*. As another exemplary configuration, hereinafter referred to as "Example B," the assembled playing card 1170 may only comprise a full second component 1171*f*, wherein the first component (again, shown partially by 1174 in FIG. 11*b*) is not attached to the second component 1171*f*. The front perspective view shown in FIG. 11*c* may be similar for both Examples A and B, which may be due to the card components being substantially flat.

Exemplary methods for the construction and attaching of the components of a customizable playing card follow. One customizable playing card component can be constructed of flexible plastic material that has been statically charged, such that said component can act as a receiving component which can attract an attaching component to adhere to it. As an example, the card components may be constructed from an electrically charged material such as polypropylene film, having a permanent charge such that the individual components may be attached to, removed from, and reattached to each other. As another example, a coating may be applied to each portion or component of the customizable playing cards, which may become charged through the act of handling the cards through regular or normal gameplay. A second customizable playing card component can be constructed of thin, flexible vinyl material that has also been statically charged, such that said component can act as an attaching component which is attracted to a receiving component. Friction can be used to statically charge the components, as is known to those of ordinary skill in the art. Both the front face and the back face of each component can be statically charged or, alternatively, only the back face of each component can be statically charged. Statically charging only the back face of the components can be more advantageous as it could result in easier shuffling and handling of the assembled playing cards. Alternatively, statically charging both faces of the card components may be advantageous because the user may be provided with more flexibility and a broader range of options in the customizing of their cards.

As an example, a first component can be a statically charged receiving component and a second component can a statically charged attaching component. Thus, an assembled playing card 1170 can be formed by the back face of a first component 1174 attracting the back face of a second component 1171*f*, such that the components statically stick together to form an Example A playing card.

FIGS. 12*a*-12*c* illustrate front perspective views of customizable playing cards wherein the portions of the cards may be associated or attached together using an interlocking mechanism, according to an aspect. A customizable playing card portion can be constructed by adhering together two thin, flexible pieces of material having similar dimensions. One edge of the portion may be secured together ("closed edge," such as the top edge, as in portion A 1272, or the bottom edge, as in portion B 1273), and the opposite edge may be provided with a slot ("slotted edge," or "open edge," such as the top edge, as in portion B 1273, or the bottom edge, as in portion A 1272). Additionally, an interlocking mechanism such as the discs ("disc" or "disc protrusion") 1281*a* and 1281*b*, or other suitable interlocking mechanism, may be provided on the slotted edge, and may be sandwiched between the two thin, flexible pieces of material, such that the interlocking mechanism protrudes past the slotted edge of the portion. The interlocking mechanisms can be statically charged via friction, for example, to create a more secure joint between two portions. As an example, the thin, flexible material used may be plastic, vinyl, or cardboard. It should be noted that a plurality of interlocking mechanisms can be used, and two exemplary interlocking mechanisms are disclosed in greater detail when referring to FIGS. 12*a* and 12*b*.

FIG. 12*a* illustrates an Example B customizable playing card in a disassembled state, wherein the portions of the customizable playing card are provided with an interlocking mechanism, according to an aspect. The first portion and second portion are constructed as an example using the method described previously. The interlocking mechanism shown in FIG. 12*a* as an example is a disc joint formed by two disc protrusions 1281*a* and 1281*b*, which may also be provided in the shape of half discs as shown as an example. An interlocking means such as the disc joint shown as an example may comprise a first interlocking section, provided on the first portion 1272, and a second interlocking section, provided on the second portion 1273. It should be understood that the sections of the interlocking means may associate together via friction, and remain associated together until a force is applied by the user, for example, to separate the sections.

As shown, it may be advantageous to construct the first portion 1272 and second portion such that the slotted edge 1282 of the first portion 1272 and a disc 1281*a* is aligned with the slotted edge 1283 of the second portion and a second disc 1281*b*. Thus, a full size second component such as 1271*f* of FIG. 12*c* can be formed by simultaneously inserting the disc 1281*a* into the slot 1283 and inserting the disc 1281*b* into the slot 1282, such that the first portion 1272 and second portion 1273 lock together. As another example, to aid in the association of the first interlocking section 1281*a* with the second interlocking section 1281*b*, magnets 1281*c* may also be provided in the interlocking means.

FIG. 12*b* illustrates another Example B customizable playing card in a disassembled state, wherein the first portion and second portion provided with another example of an interlocking mechanism, according to an aspect. The interlocking mechanism shown in FIG. 12*b* as an example is formed by interlocking teeth ("teeth") 1284*a* and 1284*b*, as may be known to those of ordinary skill in the art. As shown, it may be advantageous to construct the first portion 1272 and the second portion 1273 such that the slotted edge 1282 of the first portion 1272 and the teeth 1284*a* is aligned with the slotted edge 1283 of the second portion 1273 and the teeth 1284*b*. Thus, a full second component such as 1271*f* of FIG. 12*c* can be formed by simultaneously inserting the teeth 1284*a* into the slot 1283 and the teeth 1284*b* into the slot 1282, such that the first portion 1272 and the second portion 1273 lock together.

FIG. 12*c* illustrates an Example B customizable playing card in an assembled state, according to an aspect. A full size second component 1271*f* may be formed by interlocking a first component 1272 and second component 1273 together, thus forming an Example B customizable playing card 1270. The interlocking may be accomplished via an interlocking mechanism such as the discs 1281*a* and 1281*b* shown in FIG. 12*a*, or the teeth 1284*a* and 1284*b* shown in FIG. 12*b*.

FIGS. 12*d*-12*e* illustrate front perspective views of customizable playing cards wherein portions of the cards may be associated or attached together without using an interlocking mechanism, according to an aspect. FIG. 12*d* illustrates card components in a disassembled state, and FIG. 12*e* shows the components of FIG. 12*d* in an assembled state. Again, a customizable playing card portion can be constructed by adhering together two thin, flexible pieces of material having similar dimensions. One edge of the portion may be secured together to form a closed edge 1273, and the opposite edge may be a slotted edge 1283, as shown by portion B. Portion B, as shown as an example, may then be combined with any other card portion with or without a slotted edge. As shown as an example, portion or component C 1274, which may be a full size component, may be inserted into the slotted edge 1283 of portion B to thus create a customized, full size playing card 1270, as shown in FIG. 12*e*. Hereinafter, the exemplary playing card configuration shown by FIG. 12*e*, wherein an assembled playing card 1270 is formed by a first component 1274 and a second portion 1273, will be referred to as an "Example C" playing card.

FIGS. 13*a*-13*e* illustrate front perspective views of customizable playing cards that may be assembled together with the use of a card sleeve 1390, according to an aspect. The card sleeve 1390 may be substantially the size of a full size customizable playing card, for example, with dimensions that are slightly larger than the full size customizable playing card such that the card may be inserted and fitted snugly inside. As an example, the playing card components 1374 and 1371*f* shown in FIGS. 13*b*-13*e* may be constructed using the method described when referring to FIGS. 11*a*-11*c*, wherein the back face of each component has been statically charged to be capable of sticking together. It should be understood that the components and portions of the customizable playing cards may be used with or without card sleeves, or any combination thereof.

It should be noted that a card sleeve may be full sized or partial sized. As an example, a full card sleeve ("full sleeve") 1390 may be a card sleeve in which a first component 1374 or an assembled playing card can be inserted. A partial card sleeve may be a card sleeve in which only a portion of a card component may be inserted. A first portion partial card sleeve ("first portion sleeve") may be constructed to fit a first portion and a second portion partial card sleeve ("second portion sleeve") may be constructed to fit a second portion. It should also be noted that a combination of full or partial sleeves may be attached together and thus used to secure a customizable playing card, as will be discussed further detail herein. Therefore, it should be understood that full and partial card sleeves can be provided for fitting any customizable playing card configurations. It should also be understood that each of the card sleeves may be fully or partially transparent such that card components or pieces held within the interior of the card sleeves may be visible. As an example, a front side of a sleeve may be transparent while the rear side or back side is opaque. Thus, a rear or back side of a customizable playing card may be hidden from view when inserted into the sleeves.

As shown as examples in FIGS. 13*b*-13*e*, customizable playing cards may be placed in a full card sleeve ("full sleeve") 1390, to help protect the individual playing cards from damage, and to help the card components stay in place and in a desired configuration. The customizable playing cards can thus be placed within a full sleeve 1390 to make sure components and portions are not dislodged from or moved out of a player's intended configuration, while also protecting the card components and portions from wear and tear damage.

Figure 13A:
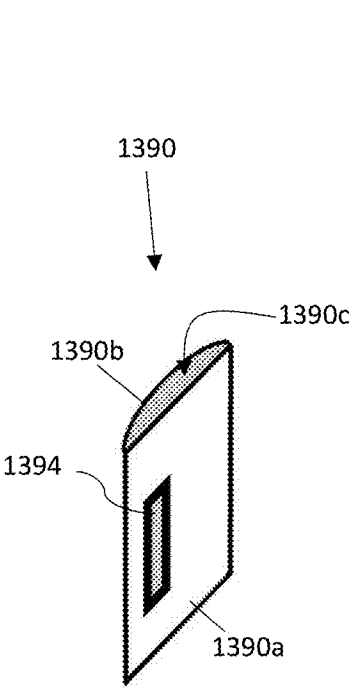
FIGS. 13*a*-13*e* illustrate front perspective views of customizable playing cards that may be assembled together with the use of a card sleeve, according to an aspect.

FIG. 13*a* illustrates an exemplary full sleeve 1390 having a front sleeve surface 1390*a* attached to a back sleeve surface 1390*b*. The front sleeve surface 1390*a* and the back sleeve surface 1390*b* may be seamed along the left and right sides and the bottom edge such that a pocket 1390*c* is formed. It should be understood, that while the pocket opening 1390*c* is shown at the top of a full sleeve 1390, the seams may also be provided on alternative sides of the sleeve such that the pocket opening 1390*c* is provided along a side edge or a bottom edge.

The sleeve 1390 may be fully constructed from clear plastic such that the card components held within may be easily visible. As another example, the front sleeve surface 1390*a* may be transparent and the back sleeve surface 1390*b* may be opaque. The pocket 1390*c* of the full sleeve 1390 may be statically charged, such that customizable playing card components 1374 and 1371*f* may be attracted to and stick to the interior of the pocket, thus reducing the risk of playing card components or portions becoming dislodged or falling out of a full sleeve 1390 when it is upside down or dropped. As another example, the pocket 1390*c* may be made of or coated with a material which increases the friction between the pocket 1390*c* and the playing card components to reduce the risk of playing card components or portions becoming dislodged or falling out of a full sleeve 1390 when it is upside down or dropped. An advantage may be that the card components may remain in a desired configuration during regular handling of the cards.

As shown in FIG. 13*a*, a full sleeve 1390 may be provided with a cutout 1394, which may be on the front sleeve surface 1390*a*. The cutout 1394 may be rectangular, for example, or any other suitable shape. The cutout 1394 may allow a user to more easily remove or insert a component into a full sleeve 1390 by allowing access to the card, such that the user may slide a component within the full sleeve 1390 up or down with their finger.

Figure 13B:
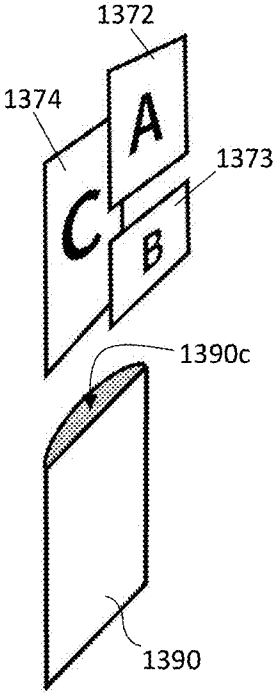

FIG. 13*b* illustrates an Example A playing card in a disassembled state and a full sleeve 1390 without a cutout. As shown, a first component ("C") 1374, a first portion ("portion A") 1372, and a second portion ("portion B") 1373 are positioned above the pocket 1390*c*, such that they can be inserted snugly into the full sleeve 1390 once assembled together.

Figure 13C:
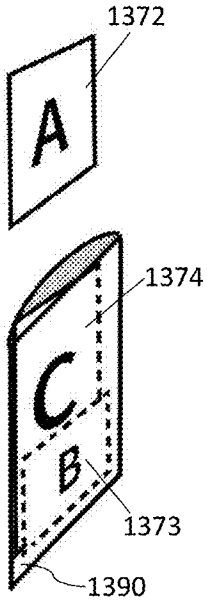

FIG. 13*c* illustrates the Example A customizable playing card of FIG. 13*b*, which has been partially inserted into a full sleeve 1390. As shown, a second portion 1373 attached to a first component 1374 has been inserted into a full sleeve 1390. A first portion 1372 is shown positioned above the full sleeve 1390, which may be inserted into the full sleeve 1390 to complete the Example A customizable playing card. A first component 1374 may act a spine to provide a customizable playing card with additional structure, thus reducing the risk of bending the full sleeve 1390 where the first portion 1372 and second portion 1373 meet and form a joint. Additionally, a first component 1374 may create a tighter fit and provide additional friction between the card components and the full sleeve 1390. A first component may also provide additional benefits and options for a card game. For example, rules and card mechanics can be hidden on a face of the first component 1374 within the full sleeve 1390, which may be revealed by a player during a card game by removal of a card component from the sleeve 1390, for example.

As previously discussed, components and portions of a customizable playing card can be swapped with other components or portions of similar size. As an example, a user can swap a first portion such as 1372 by inserting a finger into the full sleeve and removing the first portion, then inserting a different first portion (not shown) into the full sleeve. Alternatively, a user may use a cutout 1394 to remove a card portion or component.

Figure 13D:
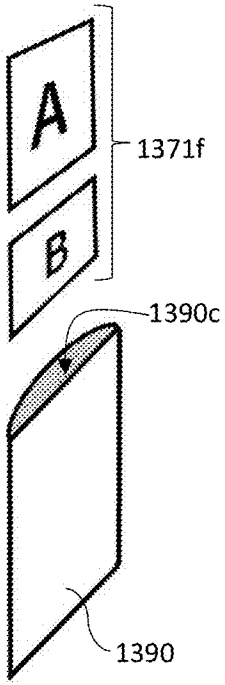

FIG. 13*d* illustrates an Example B customizable playing card in a disassembled state and an exemplary full sleeve 1390 without a cutout. A disassembled second component 1371*f* is shown positioned above a pocket 1390*c*, as an example.

Figure 13E:
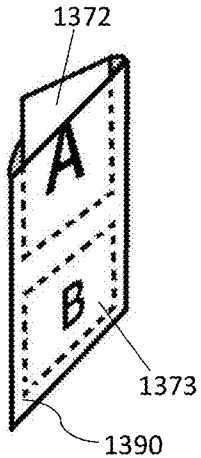

FIG. 13*e* illustrates the Example B playing card of FIG. 13*d* partially inserted into a full sleeve 1390. As shown, a second portion 1373 has been inserted into a full sleeve 1390 and a first portion 1372 is partially inserted into the full sleeve 1390. Again, the first portion 1372 can be swapped for a different first portion (not shown), and the second portion 1373 may also be swapped for other second portions (not shown), as needed by the user.

FIGS. 14*a*-14*f* illustrate front perspective views of customizable playing cards that may be assembled together with the use of a card frame ("card frame," or "frame") 1485, according to an aspect. Similar to the sleeve shown and described when referring to FIGS. 13*a*-13*e*, a card frame 1485 may be used for keeping components in place in a desired configuration, and for protecting the card components. The card components, such as portion A 1472, portion B 1473, and portion C 1474, may be sandwiched between a front and back of a card frame 1485. A card frame 1485 may be constructed of any suitable material that is thin, flexible, and easy to shuffle. Example materials may include plastic or vinyl.

The card frame 1485 may be provided with a back frame piece 1485*b* and a front frame piece 1485*a*. The front frame piece 1485*a* and the back frame piece 1485*b* of a card frame 1485 may be blank or empty, or may be provided with a transparent or opaque plastic between the inner edges of the frame. An advantage of the transparent plastic may be that the frame is more secure and may better protect the playing card components and portions from damage.

Figures 14A, 14B, 14C, 14D, 14E, 14F:
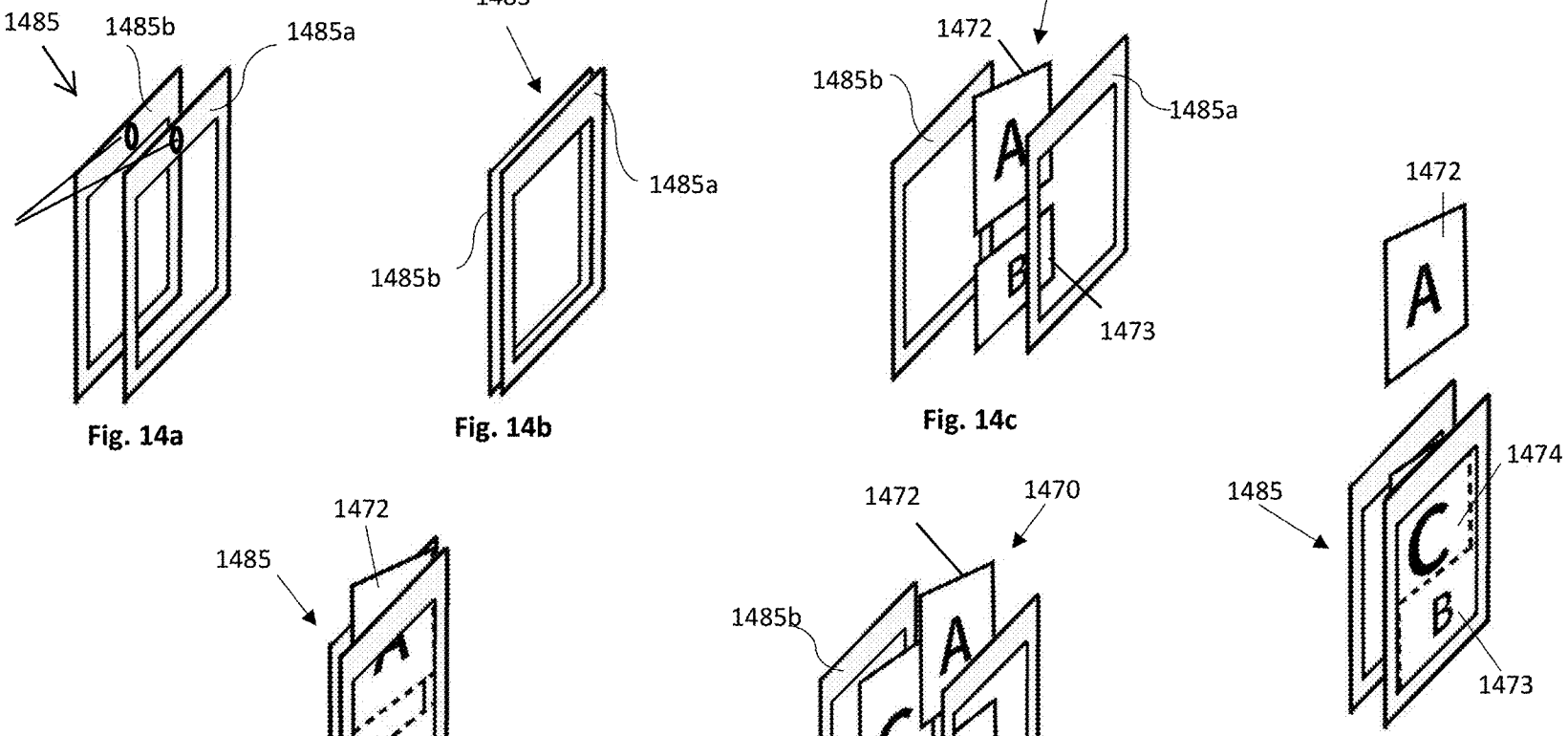
FIGS. 14*a*-14*f* illustrate front perspective views of customizable playing cards that may be assembled together with the use of a card frame, according to an aspect.

The edges of the card frames pieces 1485*a* and 1485*b* may stick together to secure card components in place, by capturing the card components in between the front frame piece 1485*a* and the back frame piece 1485*b*. As an example, the edges of the card frame pieces 1485*a* and 1485*b* may be statically charged, such that the edges attract each other and are capable of sticking together. As an example, static electricity may be used to attach the edges of the frame together, such that the plastic can also be statically charged to make the frame more secure, or, additional means may be used for adhering the frame pieces together. As another example, magnetic material may be embedded in the edges of the card frame pieces 1485*a* and 1485*b* such that the edges can magnetically stick together. As another example, the inner or interior edges of the card frame pieces 1485*a* and 1485*b* can be coated with an adhesive. It should be noted that all of the edges or only some of the edges may be provided with an adhering or attaching mechanism that allows for sticking together. It should also be noted that the card frame pieces 1485*a* and 1485*b* may be fully detachable as shown in FIG. 14*a*, partially detachable, or not detachable at all. As an example, a frame 1485 without having detachable pieces may be provided with an opening similar to the opening shown by 1390*c* in FIG. 13*a*, such that playing card components may be slipped inside. As another example, similar to the discussion of FIG. 12*a*, to aid in the association of the back frame piece 1485*b* with the front frame piece 1485*a*, magnets 1481*c* may also be provided in the frame.

FIG. 14*a* illustrates an exemplary card frame 1485 in a disassembled state, wherein the front frame piece 1485*a* and the back frame piece 1485*b* are fully detachable from one another, and may also be associated or attached together. As an example, all four edges of a fully detachable card frame may be provided with a method or mechanism for allowing the pieces to stick to one another. An advantage may be that the completely separable pieces may allow a user more freedom of movement and ease of inserting card components into a desired configuration.

FIG. 14*b* illustrates the card frame 1485 of FIG. 14*a* in an assembled state. The example shown in FIG. 14*b* may also portray a view of a card frame 1485 having partially detachable pieces ("partially detachable card frame"), wherein the front frame piece 1485*a* and the back frame piece 1485*b* are partially separable from one another. The front frame piece 1485*a* and the back frame piece 1485*b* of the partially detachable card frame 1485 may be permanently attached along one edge and the other three edges of the card frame 1485 may detach or separate from one another, thus allowing the card frame to open like a book, for example. An advantage may be that the individual pieces of the frame may be kept together and it may be easier for the user to not lose the pieces.

FIG. 14*c* illustrates an Example B customizable playing card in a disassembled state within a fully detachable card frame 1485, as shown and described when referring to FIG. 14*a*. A disassembled second component 1471*f* is shown positioned in between the front frame piece 1485*a* and the back frame piece 1485*b*. After assembling the card components 1472 and 1473 into a desired configuration, the components may be enclosed within the frame 1485.

FIG. 14*d* illustrates the Example B playing card of FIG. 14*c*, which has been partially placed within a card frame 1485, according to an aspect. As shown, a second portion 1473 has been placed between the pieces of a card frame 1485 and a first portion 1372 is partially inserted within the card frame 1485 through an opening at the top end of the frame. As mentioned hereinbefore, components and portions of a customizable playing card can be swapped with other components or portions of similar size. As an example, a first portion 1472 can be swapped by removing the it from the card frame 1485 and replacing it with a new first portion (not shown).

FIG. 14*e* illustrates an exploded view of an Example A playing card in a disassembled state and a fully detachable card frame 1485, which may be similar to the view shown in FIG. 14*c*. As shown, a first component 1474, a first portion 1472, and a second portion 1473 are in between the front frame piece 1485*a* and the back frame piece 1485*b*, such that the card frame edges can be attached around an assembled Example A playing card, enclosing the playing card within. In this configuration, the portion A 1472 and the portion B 1473 may be placed on top of the component C 1474.

FIG. 14*f* illustrates the Example A customizable playing card of FIG. 14*e* partially placed within a card frame 1485. As shown, a second portion 1473 attached to a first component 1474 has been placed within a card frame 1485. A first portion 1472 is shown positioned above the card frame 1485, which may then be fitted within the card frame 1485 to complete the Example A customizable playing card. A first component 1474 may act a spine to provide a customizable playing card with additional structural support, thus reducing the risk of the card frame 1485 and/or the assembled playing card bending where the first portion 1472 and second portion 1473 meet and form a joint. Additionally, a first component 1474 may create a tighter fit and provide additional static attraction between the card components and the card frame 1485. A first component may also provide additional benefits and options for a card game. For example, rules and card mechanics can be hidden on a face of the first component 1474 within the card frame 1485, which may be revealed by a player during a card game. Again, as previously discussed, components and portions of a customizable playing card can be swapped with other components or portions of the same or similar size.

FIGS. 15*a*-15*e* illustrate a left side perspective view of a card clip ("card clip," or "clip,") and examples of front perspective views of customizable playing cards that may be assembled together with the use of the card clip, respectively, according to an aspect. As an example, a card clip 1586 may be used to keep components in place or together in a desired configuration. A card clip 1586 may be constructed such that it does not interfere with or hinder card shuffling when clipped around the edge of a customizable playing card.

Figure 15A:
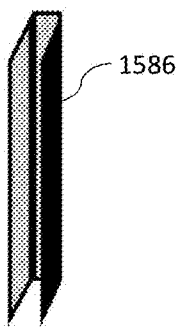
FIGS. 15*a*-15*e* illustrate a left side perspective view of a card clip and examples of front perspective views of customizable playing cards that may be assembled together with the use of the card clip, respectively, according to an aspect.

FIG. 15*a* illustrates an exemplary card clip 1586 which may be used to hold card components in place. A card clip 1586 may be constructed from any suitable material, such that the card clip 1586 is thin, holds its shape, and can provide a sufficient amount of tension to keep card components in place. An appropriate material may be plastic, for example. As an example, when plastic is used to construct a card clip 1586, the card clip may be statically charged to reduce the risk of the card clip becoming dislodged from the card components.

Figure 15B:
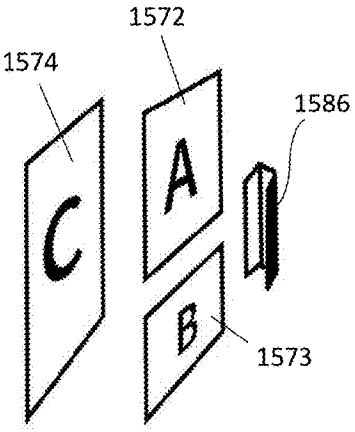

FIG. 15*b* illustrates an Example A customizable playing card in a disassembled state and a card clip 1586, according to an aspect. As shown, a first component 1574, a first portion 1572, and a second portion 1573 are positioned such that, when assembled, a card clip may be secured to the edge of the assembled playing card.

Figure 15C:
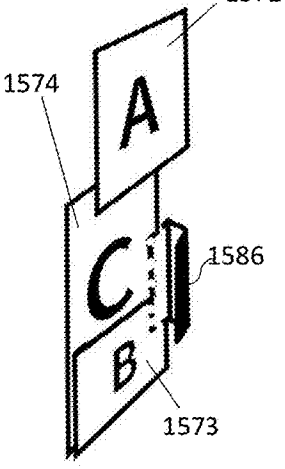

FIG. 15*b* illustrates the Example A playing card of FIG. 15*b* in a partially assembled state with a card clip 1586. As shown, a second portion 1573 and a first component 1574 are attached and a card clip 1586 may then be secured to one of the long or lengthwise edges of the customizable card. A first portion 1572 is shown positioned slightly near the first component 1574, the second portion 1573, and the card clip 1586, such that the first portion 1572 may be attached to the first component 1574 and the card clip can next be secured around one of its long or lengthwise edges, as is shown in FIG. 15*c*.

It may be advantageous to secure the card clip 1586 around one of the long or lengthwise edges of a customizable playing card, such that the joint formed by the edges of the first portion 1572 and second portion 1573 (which may be adjacent to or aligned with each other) is located near the center of the card clip 1586, thus increasing the strength of the joint. A first component 1574 may act a spine to provide a customizable playing card with additional structural support, thus reducing the risk of the card bending where the first portion 1572 and second portion 1573 meet. Additionally, a first component 1574 may create a tighter fit and provide additional friction between the card components and the cad clip 1586. Again, a first component 1574 may provide additional benefits and options for a card game, such as providing a card face for having instructions, rules, and so on.

Again as previously discussed, components and portions of a customizable playing card can be swapped with other components or portions of similar size. As an example, a user can swap a first portion 1572 by detaching it from a first component 1574, removing the first portion by slipping it out of the card clip 1586, then securing a card clip 1586 around a new first portion (not shown) and attaching the new first portion to the first component 1574.

Figure 15D:
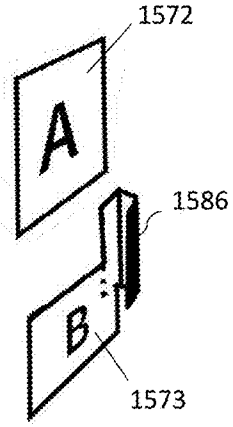

FIG. 15*d* illustrates the Example B playing card of FIG. 15*d*, wherein a card clip 1586 has been secured around the second portion 1573, and may also receive the first portion 1572. As shown, the first portion 1572 is positioned near a second portion 1573 and the card clip 1586 such that the card clip 1586 may be secured around one of the edges of the first portion 1572 to create an assembled Example B playing card. Again, the first portion 1572 can be swapped for a different first portion (not shown).

Figure 15E:
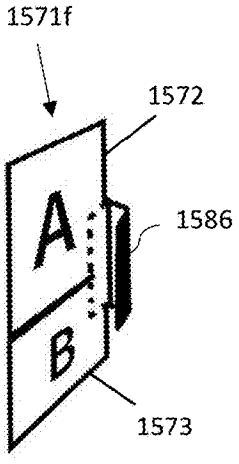

FIG. 15*e* illustrates an Example B customizable playing card 1571*f* in an assembled state with an exemplary card clip 1586 secured around the playing card 1571*f* at the joint formed between the first portion 1572 and the second portion 1573.

Figure 16C:
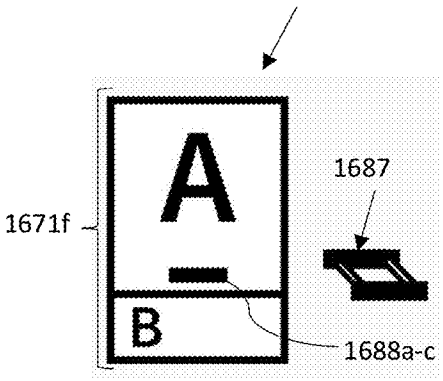
FIGS. 16*a*-16*c* illustrate front perspective views of customizable playing cards that may be assembled together with the use of a card pin 1687, according to an aspect.
Figure 16B:
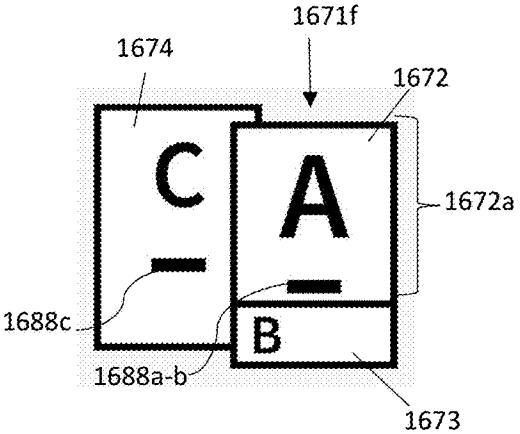
Figure 16A:
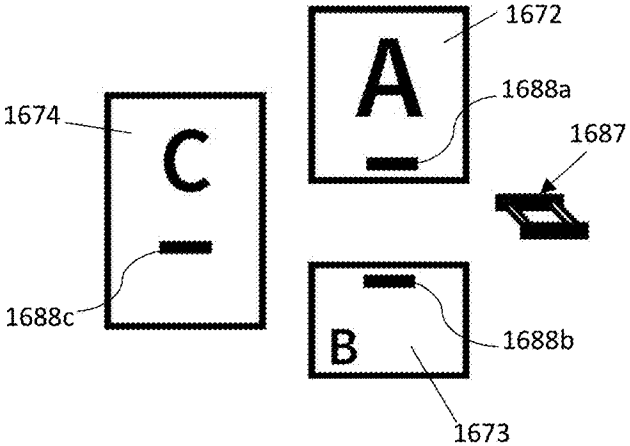

FIGS. 16*a*-16*c* illustrate front perspective views of customizable playing cards that may be assembled together with the use of a card pin 1687, according to an aspect. A card pin 1687 may be used to keep components in place and together in a desired configuration. A card pin 1687 may be constructed to be small and thin such that it does not interfere with or hinder card shuffling when the card pin 1687 is used for pinning card components together.

FIG. 16*a* illustrates a disassembled Example A playing card and an exemplary card pin 1687. As shown, a front component 1674, a first portion 1672, and a second portion 1673 may be provided with pin slots 1688*c*, 1688*a*, and 1688*b*, respectively. The pin slots 1688*a*-1688*c* may be positioned on the card components and portions, such that, when the card is assembled, the pin slots are aligned such that a card pin 1687 may be placed through all three slots to secure the components together. As another example, a card portion or component may be provided with multiple pin slots, such that a variety of card configurations may be possible.

A card pin 1687 may be constructed of any suitable material, such that the card pin 1687 is thin, and can hold its shape. An appropriate material may be plastic, for example. As an example, when plastic is used to construct a card pin 1687, the card pin may be statically charged to reduce the risk of the card pin being dislodged from the card components and portions, for example. As shown, it may be advantageous to position the pin slots 1688*a*-1688*c* and the card pin 1687 near the center of a customizable playing card. Thus, the joint formed by the pin slots 1688*a*-1688*c* and the card pin 1687 may be more secure and the card components may be less likely to dislodge from one another.

FIG. 16*b* illustrates the Example A playing card of FIG. 16*a* in a partially assembled state. A first portion 1672 may have a longer vertical length 1672*a*, such that the bottom of the first portion 1672*a* and the top of the second portion 1673 overlap, allowing the pin slots 1688*a* and 1688*b* to be aligned. FIG. 16*b* shows a first portion 1672 positioned on top of a second portion 1673 to form a full second component 1671*f*, wherein the pin slots 1688*a* and 1688*b* are aligned with the pin slot 1688*a* on top. A first component 1674 with a pin slot 1688*c* is shown positioned near the full second component 1671*f*, such that the two components can be assembled to create an Example A playing card, as shown in FIG. 16*c*. A first component 1674 may act a spine to provide a customizable playing card with additional structural support, thus reducing the of the customizable playing card bending. Additionally, a first component 1674 may create a tighter fit and provide additional friction between the card components and the cad pin 1687.

FIG. 16*c* illustrates the Example A playing card of FIGS. 16*a*-16*b* in an assembled state, wherein a card pin 1687 can be inserted into the pin slots 1688*a*-1688*c*. As shown, a full second component 1671*f* is positioned on top of a first component 1674 of FIGS. 16*a*-16*b*, such that the pin slots 1688*a*-1688*c* are all aligned with one another. Next, to secure the assembled Example A playing card 1670 components together, a card pin 1687 may be inserted through the pin slots 1688*a*-1688*c*.

Again as previously discussed, components and portions of a customizable playing card can be swapped with other components or portions of similar size. As an example, a user can swap a first portion 1672 by removing the card pin 1687, then detaching the first portion 1672 from the first component 1674 and second portion 1673. Next, a user can swap the first component 1672 with a new first portion (not shown) and attach the new first portion to the first component 1674 and second portion 1673 with the card pin 1687, as disclosed hereinabove.

FIGS. 17*a*-17*e* illustrate front perspective views of combination card sleeves in a separated state, in a joined state, and examples of customizable playing cards that may be assembled together with the use of the combination card sleeves, respectively, according to an aspect. As previously shown and described when referring to FIGS. 13*a*-13*e*, full and partial card sleeves may be provided, and may be constructed using the method disclosed when referring to FIG. 13*a*. Additionally, full and partial card sleeves, or a combination thereof, may be used to secure and protect customizable playing card components and portions.

Figure 17A:
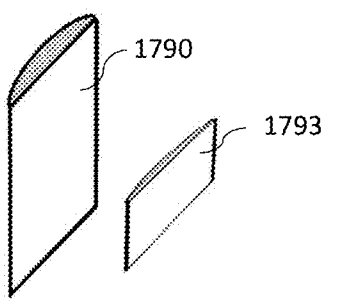
FIGS. 17*a*-17*e* illustrate front perspective views of combination card sleeves in a separated state, in a joined state, and examples of customizable playing cards that may be assembled together with the use of the combination card sleeves, respectively, according to an aspect.

FIG. 17*a* illustrates a combination card sleeve comprising a full card sleeve 1790 and a partial card sleeve 1793 combination in a separated state. A first component (as shown by 1774 in FIG. 17*c*) may be inserted into a full sleeve 1790 and a second portion (as shown by 1773 in FIG. 17*c*) of a second component may be inserted into the partial card sleeve 1793.

Figure 17B:
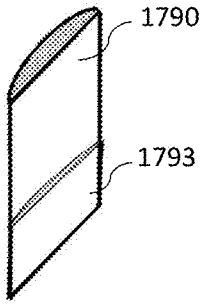

FIG. 17*b* illustrates the combination card sleeves of FIG. 17*a* in an attached or joined state. As shown, the partial card sleeve 1793 may be attached to a full sleeve 1790. As an example, a strong, flexible adhesive may be used to attach the second portion sleeve 1793 to the full sleeve 1790. Other suitable adhesives or attachment methods such as static electricity may also be used, for example.

Figure 17C:
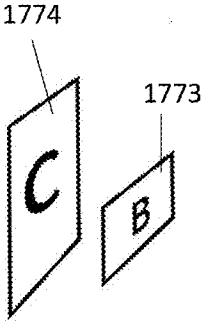

FIG. 17*c* illustrates an Example C playing card in a disassembled state, according to an aspect. As shown, a second portion 1773 is positioned near a first component 1774, such that they may form an Example C playing card when assembled.

Figure 17D:
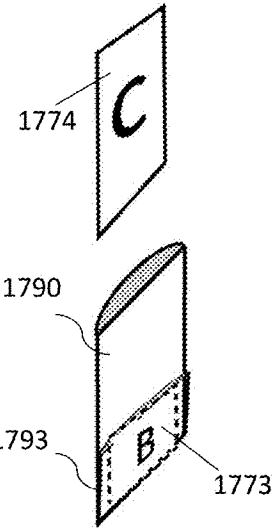

FIG. 17*d* illustrates the Example C playing card of FIG. 17*c* partially inserted into the combination card sleeve of FIG. 17*b*. As shown, a second portion 1773 is inserted into a partial card sleeve 1793, which has been adhered to the full card sleeve 1790, and a first component 1774 is positioned above the full sleeve 1790. Again as previously discussed, components and portions of a customizable playing card can be swapped with other components or portions of similar size. As an example, a user can swap a first component such as 1774 for a different first component (not shown) using the method described when referring to FIG. 13*c*.

Figure 17E:
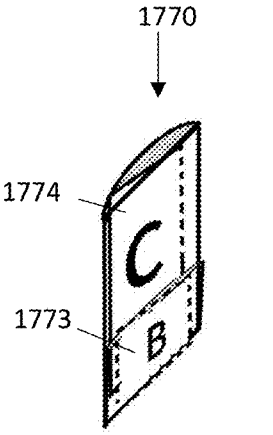

FIG. 17*e* illustrates the Example C playing card 1770 of FIGS. 17*c*-17*d* in an assembled state and inserted into the combination card sleeves. As shown, both the first component 1774 and second portion 1773 have been inserted into the attached or joined full sleeve 1790 and the partial card sleeve 1793, respectively. Thus, an Example C playing card 1770 is assembled and secured together by the joined portions of the combination card sleeves. An advantage may be that the user may not need to remove portions of the playing cards from sleeves when mixing and matching portions together. For example, portion B 1773 may remain in the partial card sleeve 1793 while being detached from the full sleeve 1790. Next, a new or different portion B 1773 in another partial card sleeve 1793 may be attached to the full sleeve 1790, creating a new customizable playing card 1770.

FIGS. 18*a*-18*e* illustrate additional examples of front perspective views of combination card sleeves in a separated state, in a joined state, and examples of customizable playing cards that may be assembled together with the use of the combination card sleeves, respectively, according to an aspect. A card sleeve support spine ("sleeve spine," "sleeve support pine," or "card sleeve support spine") 1894 may be used with the combination card sleeves, and may provide structural support.

Figure 18A:
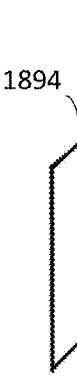
FIGS. 18*a*-18*e* illustrate additional examples of front perspective views of combination card sleeves in a separated state, in a joined state, and examples of customizable playing cards that may be assembled together with the use of the combination card sleeves, respectively, according to an aspect.

FIG. 18*a* illustrates an exemplary sleeve spine 1894 and combination card sleeves in a separated state. The combination card sleeves may include a first partial sleeve 1892 and a second partial sleeve 1893, which, again, may be constructed as disclosed when referring to FIG. 13*a*. Again as previously discussed, a portion of a second component can be inserted into a first partial sleeve 1892 and a second portion of a second component can be inserted into a second partial sleeve 1893.

Figure 18B:
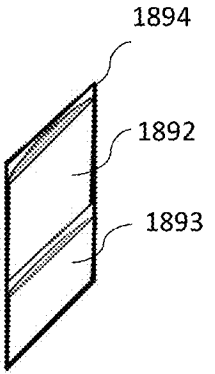

FIG. 18*b* illustrates the sleeve spine 1894 and the combination card sleeves of FIG. 18*a* in an attached or joined state. As shown in FIG. 18*b*, a first partial sleeve 1892 and a second partial sleeve 1893 can be attached to a sleeve spine 1890. Thus, a sleeve spine 1890 may provide a method for combining partial card sleeves, similar to the full card sleeve (shown by 1790 in FIG. 17*a*). Additionally, a sleeve spine 1890 may also provide a customizable playing card with additional structural support, thus reducing the risk that a partial card sleeve combination may bend where the first partial sleeve 1892 and second partial sleeve 1893 meet. As an example, a strong, flexible adhesive can be used to attach the first portion sleeve 1892 and second portion sleeve 1893 can be attached to the sleeve spine 1890.

Figure 18C:
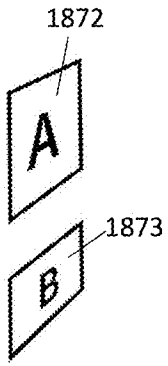

FIG. 18*c* illustrates an Example B playing card in a disassembled state, which may be used with combination card sleeves to construct or assemble a customizable playing card. As shown, a first portion 1872 and second portion 1873 are positioned near each other, such that they may form an Example B playing card when assembled.

Figure 18D:
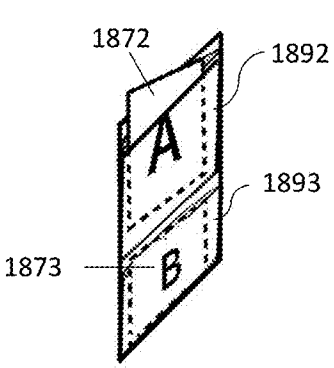

FIG. 18*d* illustrates the Example B playing card of FIG. 18*c* partially inserted into the combination card sleeves of FIG. 18*b*. As shown, a second portion 1873 has been fully inserted into a second partial sleeve 1893 and a first portion 1892 has been partially inserted into a first partial sleeve 1892. Once the first portion 1872 is fully inserted into the first portion sleeve 1892, an assembled Example B playing card may be formed.

Figure 18E:
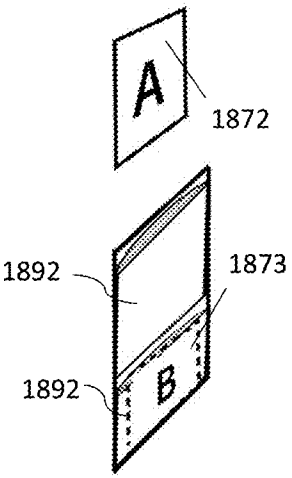

FIG. 18*e* illustrates the Example C playing card 1870 of FIGS. 18*c*-18*d* in a partially assembled state, according to an aspect. As shown, the second portion 1873 has been inserted into second partial sleeve 1893 and the first portion 1872 is positioned above the first partial sleeve 1892, as may occur when portion A 1872 is swapped for a new or different portion A 1872. Again as previously discussed, components and portions of a customizable playing card can be swapped with other components or portions of similar size. As an example, a user can swap a first portion such as 1382 for a different first portion (not shown) using the method disclosed when referring to FIG. 13*c*. As an example, FIG. 18*e* shows a user in the process of swapping the first portion 1872 of an Example B customizable playing card for a new first portion (not shown).

FIGS. 19*a*-19*d* illustrate an exemplary method of applying a coating 1975 to a customizable playing card, shown in an unassembled state, according to an aspect. It should be understand that the various components, portions, and pieces of the customizable playing card may also be coated with a film coating ("film," "film coating," or "coating") which may provide the components with additional protection, as well as an additional static charge. The coating may be statically charged such that the individual components, portions, and pieces of the customizable playing card may be more easily adhered to one another. It should be understood that the components may be removably adhered to each other.

Figures 19A, 19B, 19C, 19D:
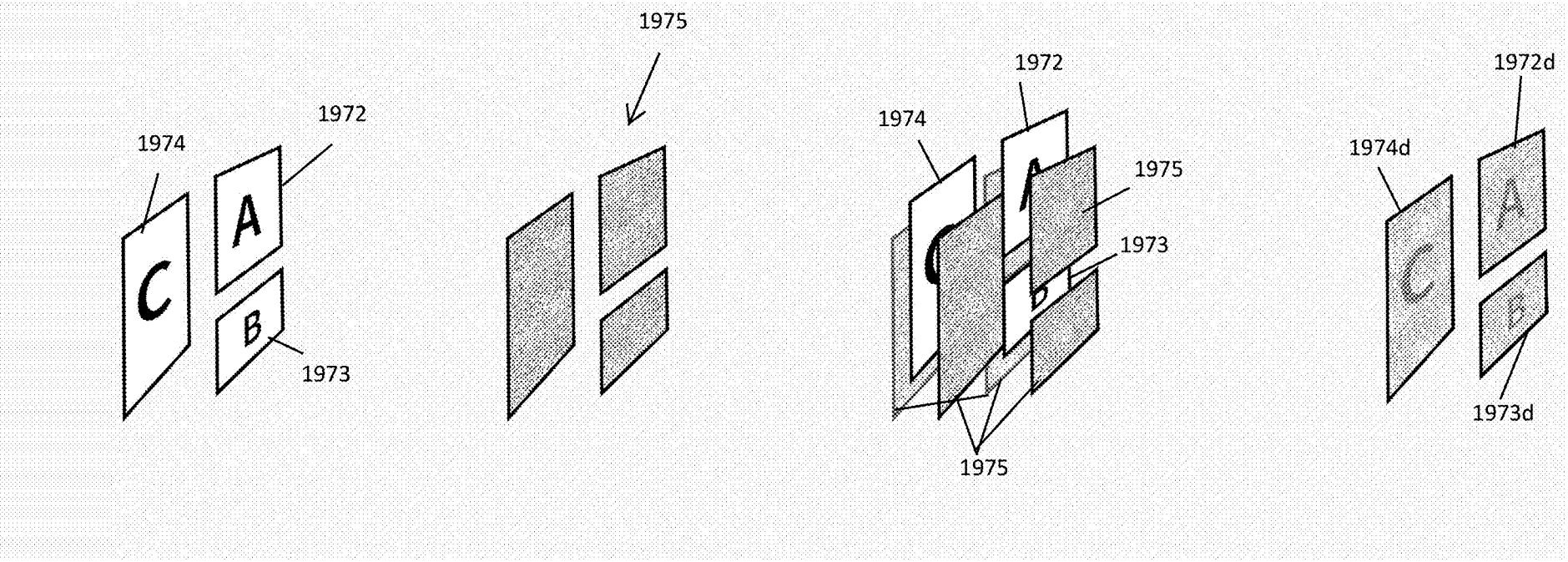
FIGS. 19*a*-19*d* illustrate an exemplary method of applying a coating to a customizable playing card, shown in an unassembled state, according to an aspect.

As shown in FIG. 19*a*, the card pieces 1972-1974 may each receive a coating, as shown by 1985 in FIG. 19*b*. FIG. 19*c* shows that a coating 1975 may be applied to both the front and rear sides of each card piece 1972-1974. FIG. 19*d* shows each piece with a coating applied 1972*d*, 1973*d*, and 1974*d*. The coating may easily become statically charged during normal or regular use of the playing cards, for example.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A customizable playing card comprising:
- a front card face;
- a back card face;
- a top card end;
- a bottom card end;
- a plurality of connectable surfaces, wherein each surface of the plurality of connectable surfaces is capable of being removably adhered to each other surface of the plurality of connectable surfaces via static electricity;
- a first card component; and
- a second card component that joins with the first card component via the static electricity to form the customizable playing card;

the first card component having:
- a front first card component face;
- a back first card component face; and
- a first set of dimensions;

the second card component having:
- a front second card component face;
- a back second card component face;
- an interlocking means having a first interlocking section, and a second interlocking section;
- a first portion, wherein the first interlocking section is on the first portion; and
- a second portion that joins with the first portion to form the second card component, wherein the second interlocking section is on the second portion, and wherein the first portion and the second portion are joined together via the interlocking means;
- wherein the first portion together with the second portion have the first set of dimensions;

a plurality of combinable card sleeves, wherein each card sleeve of the plurality of combinable card sleeves is capable of being removably adhered to each other card sleeve of the plurality of combinable card sleeves, the plurality of combinable card sleeves comprising:
- a full size card sleeve having a full size card sleeve exterior, and a full size card sleeve interior, the full size card sleeve being adapted to receive the first card component into the full size card sleeve interior;
- a first partial size card sleeve having a first partial size card sleeve exterior, and a first partial size card sleeve interior, the first partial size card sleeve being adapted to receive the first portion into the first partial size card sleeve interior; and
- a second partial size card sleeve having a second partial size card sleeve exterior, and a second partial size card sleeve interior, the second partial size card sleeve being adapted to receive the second portion into the second partial size card sleeve interior;

wherein the plurality of connectable surfaces comprises the front first card component face, the back first card component face, the front second card component face; the back second card component face; the full size card sleeve exterior, the first partial size card sleeve exterior, and the second partial size card sleeve exterior;

wherein the surfaces of the plurality of connectable surfaces are connected such that the front first component face is visible and comprises the front card face; and such that the front second component face is opposite to the front first component face and is visible and comprises the back card face.

2. The customizable playing card of claim 1, wherein each surface of the plurality of connectable surfaces has a film coating having a static electricity charge.

3. The customizable playing card of claim 1, wherein the interlocking means further comprises magnets.

4. The customizable playing card of claim 1, wherein the first interlocking section comprises a first half disc, and the second interlocking section comprises a second half disc adapted to be associated with the first half disc.

5. The customizable playing card of claim 1, wherein the first interlocking section comprises a first set of teeth, and the second interlocking section comprises a second set of teeth adapted to be associated with the first set of teeth.

6. The customizable playing card of claim 1, wherein the first portion has a second set of dimensions, and the second portion has a third set of dimensions, wherein the second set of dimensions and the third set of dimensions are each smaller than the first set of dimensions.

7. The customizable playing card of claim 1, wherein the full size card sleeve comprises a cutout adapted to allow access to the full size card sleeve interior.

8. The customizable playing card of claim 1, the plurality of connectable surfaces further comprising a spine adapted to be removably adhered to a card sleeve of the plurality of combinable card sleeves.

9. A customizable playing card comprising:
a front card face;
a back card face;
a top card end;
a bottom card end;
a plurality of connectable surfaces, wherein each surface of the plurality of connectable surfaces is capable of being removably adhered to each other surface of the plurality of connectable surfaces via static electricity;
a first card component; and
a second card component that joins with the first card component via the static electricity to form the customizable playing card;
the first card component having:
a front first card component face;
a back first card component face; and
a first set of dimensions;
the second card component having:
a front second card component face;
a back second card component face;
an interlocking means having a first interlocking section, and a second interlocking section;
a first portion, wherein the first interlocking section is on the first portion; and
a second portion that joins with the first portion to form the second card component, wherein the second interlocking section is on the second portion, and wherein the first portion and the second portion are joined together via the interlocking means;
wherein the first portion together with the second portion have the first set of dimensions;
a card frame having:
a front frame piece;
a back frame piece;
a frame exterior; and
a frame interior;
wherein the card frame is adapted to receive the first card component and the second card component into the frame interior;
wherein the plurality of connectable surfaces comprises the front first card component face, the back first card component face, the front second card component face; the back second card component face; the front frame piece, and the back frame piece;
wherein the first card component and the second card component are connected together within the card frame;
such that the front first component face is visible and comprises the front card face; and
such that the front second component face is opposite to the front first component face and is visible and comprises the back card face.

10. The customizable playing card claim 9, wherein each surface of the plurality of connectable surfaces has a film coating having a static electricity charge.

11. The customizable playing card of claim 9, wherein the first portion has a second set of dimensions, and the second portion has a third set of dimensions, wherein the second set of dimensions and the third set of dimensions are each smaller than the first set of dimensions.

12. The customizable playing card of claim 9, wherein the front frame piece and the back frame piece are removable from each other.

13. The customizable playing card of claim 9, wherein the front frame piece and the back frame piece are attached along a lengthwise edge, such that the front frame piece and the back frame piece are partially removable from each other.

14. The customizable playing card of claim 9, wherein the first interlocking section comprises a first half disc, and the second interlocking section comprises a second half disc adapted to be associated with the first half disc.

15. A customizable playing card comprising:
a front card face;
a back card face;
a top card end;
a bottom card end;
a left lengthwise side;
a right lengthwise side;
a plurality of connectable surfaces, wherein each surface of the plurality of connectable surfaces is capable of being removably adhered to each other surface of the plurality of connectable surfaces via static electricity;
a first card component; and
a second card component that joins with the first card component via the static electricity to form the customizable playing card;
the first card component having:
a front first card component face; and
a back first card component face;
the second card component having:
a front second card component face; and
a back second card component face;
wherein the first card component connects to the second card component such that the front first component face is visible and comprises the front card face; and
such that the front second component face is opposite to the front first component face and is visible and comprises the back card face.

16. The customizable playing card of claim 15, wherein each surface of the plurality of connectable surfaces has a film coating having a static electricity charge.

17. The customizable playing card of claim 15, further comprising a card clip adapted to grip onto the left lengthwise side or the right lengthwise side.

18. The customizable playing card of claim 15, further comprising a pin; and the first card component further comprising a first pin slot; and the second card component further comprising a second pin slot; wherein the first pin slot and the second pin slot are aligned when the first card component is connected to the second card component, and wherein the pin is adapted to fit through the aligned first pin slot and the second pin slot, and hold together the first card component and the second card component.

19. The customizable playing card of claim 15, wherein the second card component comprises a first portion, and a second portion that joins with the first portion to form the second card component.

20. The customizable playing card of claim 19, the second card component further comprising:
an interlocking means having a first interlocking section, and a second interlocking section;
wherein the first interlocking section is on the first portion;
wherein the second interlocking second is on the section portion; and wherein the first portion and the second portion are joined together via the interlocking means.

* * * * *